US008978535B2

(12) United States Patent
Ortiz et al.

(10) Patent No.: US 8,978,535 B2
(45) Date of Patent: Mar. 17, 2015

(54) ARTICULATING PROTECTIVE SYSTEM FOR RESISTING MECHANICAL LOADS

(75) Inventors: Christine Ortiz, Melrose, MA (US); Mary C. Boyce, Winchester, MA (US); Juha Song, Cambridge, MA (US); Steffen H. Reichert, Stuttgart (DE)

(73) Assignee: Massachusetts Institute of Technology, Cambridge, MA (US)

( * ) Notice: Subject to any disclaimer, the term of this patent is extended or adjusted under 35 U.S.C. 154(b) by 156 days.

(21) Appl. No.: 13/207,681

(22) Filed: Aug. 11, 2011

(65) Prior Publication Data

US 2012/0137864 A1 Jun. 7, 2012

Related U.S. Application Data

(60) Provisional application No. 61/372,806, filed on Aug. 11, 2010.

(51) Int. Cl.

| | |
|---|---|
| ***F41H 5/00*** | (2006.01) |
| ***F16F 7/00*** | (2006.01) |
| ***B65D 81/02*** | (2006.01) |
| ***F41H 5/04*** | (2006.01) |

(52) U.S. Cl.

CPC ..... *F41H 5/04* (2013.01); *F41H 5/0492* (2013.01)

USPC ..... 89/36.01; 89/918; 89/921; 206/521; 267/136

(58) Field of Classification Search

USPC ..... 89/36.01, 36.02, 36.04, 36.05, 36.07, 89/36.08, 36.09, 36.12; 206/521, 585; 267/136

See application file for complete search history.

(56) References Cited

U.S. PATENT DOCUMENTS

| | | | | |
|---|---|---|---|---|
| 3,148,477 | A * | 9/1964 | Bjørn et al. | 52/591.2 |
| 3,662,404 | A * | 5/1972 | Schinker | 2/243.1 |
| 3,867,239 | A * | 2/1975 | Alesi et al. | 428/48 |
| 4,004,493 | A * | 1/1977 | Costanza | 89/36.02 |
| 4,179,979 | A * | 12/1979 | Cook et al. | 89/36.02 |
| 4,198,707 | A * | 4/1980 | Haupt et al. | 2/2.5 |
| 5,217,185 | A * | 6/1993 | Rucker | 244/121 |
| 5,738,925 | A | 4/1998 | Chaput | |
| 6,012,680 | A * | 1/2000 | Edberg et al. | 244/173.2 |
| 6,050,044 | A * | 4/2000 | McIntosh | 52/591.1 |
| 6,170,378 | B1 | 1/2001 | Neal et al. | |
| 6,401,887 | B1 * | 6/2002 | Hur | 188/376 |

(Continued)

FOREIGN PATENT DOCUMENTS

| | | |
|---|---|---|
| EP | 1 135 663 B1 | 2/2006 |
| GB | 2 004 177 A | 3/1979 |

(Continued)

OTHER PUBLICATIONS

Bruet, et al., "Materials design principles of ancient fish armor," *Nature Materials*. 2008; 7:748-756.

(Continued)

*Primary Examiner* — Bret Hayes

(74) *Attorney, Agent, or Firm* — Wolf, Greenfield & Sacks, P.C.

(57) ABSTRACT

Articulating protective systems for resisting mechanical loads and related methods are generally described. The protective structures described herein can incorporate one or more features that enhance the ability of the structure to resist an applied force while remaining sufficiently flexible to allow for movement of the object or person the structure is designed to protect.

55 Claims, 19 Drawing Sheets

(56) References Cited

U.S. PATENT DOCUMENTS

| | | | | |
|---|---|---|---|---|
| 6,502,496 | B1 | 1/2003 | Ravid et al. | |
| 6,676,116 | B2 * | 1/2004 | Edberg et al. | 267/136 |
| 6,703,104 | B1 | 3/2004 | Neal | |
| 6,705,197 | B1 | 3/2004 | Neal | |
| 6,718,861 | B1 | 4/2004 | Anderson, Jr. et al. | |
| 6,745,661 | B1 | 6/2004 | Neal et al. | |
| 6,842,908 | B1 * | 1/2005 | Saito | 2/2.5 |
| 6,860,186 | B2 | 3/2005 | Cohen | |
| 7,430,768 | B2 | 10/2008 | Batstone et al. | |
| 7,500,422 | B2 | 3/2009 | Mazur | |
| 7,523,693 | B1 | 4/2009 | Engelhart | |
| 7,546,796 | B2 | 6/2009 | Hunn | |
| 7,556,855 | B2 | 7/2009 | Biermann et al. | |
| 7,562,612 | B2 * | 7/2009 | Lucuta et al. | 89/36.02 |
| 7,681,485 | B2 | 3/2010 | Neal | |
| 7,703,375 | B1 | 4/2010 | Scott et al. | |
| 7,721,348 | B2 | 5/2010 | Nurnberg | |
| 7,793,579 | B1 * | 9/2010 | Lee | 89/36.02 |
| 2007/0006542 | A1 * | 1/2007 | Duke | 52/561 |
| 2010/0043112 | A1 | 2/2010 | Khandelwal | |
| 2010/0080971 | A1 | 4/2010 | Neal | |
| 2010/0282060 | A1 * | 11/2010 | Duke et al. | 89/36.02 |

FOREIGN PATENT DOCUMENTS

| | | | |
|---|---|---|---|
| WO | WO 92/08094 | A1 | 5/1992 |
| WO | WO 92/16813 | A1 | 10/1992 |
| WO | WO 00/33013 | A2 | 6/2000 |
| WO | WO 2009/095903 | A1 | 8/2009 |
| WO | WO 2013/028150 | A2 | 2/2013 |

OTHER PUBLICATIONS

Reichert, "Reverse Engineering Nature: Design Principles for Flexible Protection Inspired by Ancient Fish Armor of Polypteridae," Thesis, Massachusetts Institute of Technology. Catalogued Aug. 31, 2010; 1-101.

International Search Report and Written Opinion for Application No. PCT/US2011/047358 mailed Apr. 11, 2013.

* cited by examiner

ARTICULATING PROTECTIVE SYSTEM FOR RESISTING MECHANICAL LOADS

RELATED APPLICATIONS

This application claims priority under 35 U.S.C. §119(e) to U.S. Provisional Patent Application Ser. No. 61/372,806, filed Aug. 11, 2010, and entitled "Articulating Protective System for Resisting Mechanical Loads," which is incorporated herein by reference in its entirety for all purposes.

GOVERNMENT SPONSORSHIP

This invention was made with government support under Grant No. W911NF-07-D-0004 awarded by the ARO and Grant No. N00244-09-1-0064 awarded by the Navy. The government has certain rights in this invention.

FIELD OF INVENTION

Articulating protective systems for resisting mechanical loads and related methods are generally described.

BACKGROUND

Systems designed to resist mechanical loads can be useful in protecting objects from damage imparted by applied forces in a wide variety of systems. For example, load-resistant systems can be incorporated into systems designed to protect the human body (e.g., in body armor). Load-resistant systems can also be useful in protecting moving vehicles such as cars, buses, and trains. Such systems also might find use in architectural applications, providing protection to surfaces (e.g., exterior walls, roofs, etc.) of buildings. Many previous load-bearing systems are either relatively inflexible, or sacrifice protection to achieve flexibility. There remains a need for improved load-bearing systems, structures, materials, and methods which simultaneously allow for flexibility and increased ranges of motion, while not sacrificing protective capability.

SUMMARY OF THE INVENTION

The invention described herein generally relates to articulating protective systems, and related methods, for resisting mechanical loads. The subject matter of the present invention involves, in some cases, interrelated products, alternative solutions to a particular problem, and/or a plurality of different uses of one or more systems and/or articles.

In one aspect, a non-naturally occurring protective article for resisting a mechanical load is described. The article can comprise, in some embodiments, a plurality of load-resistant units arranged to form a plurality of rows. In some cases, at least one row contains a first unit comprising a protrusion housed within an indentation in a first adjacent unit. In some embodiments, at least one row is constructed and arranged such that it at least partially overlaps an adjacent row.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1A:
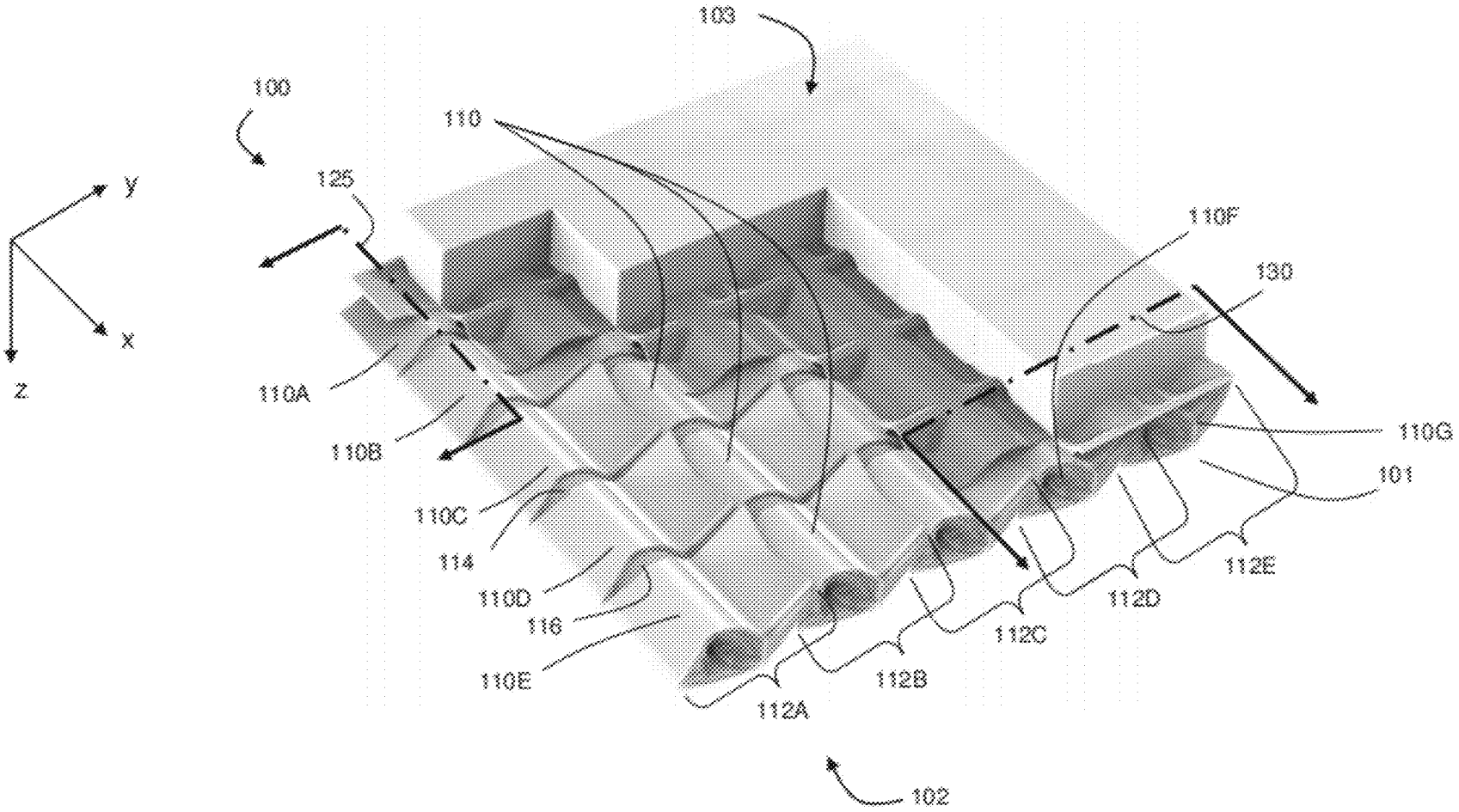
FIGS. 1A-1C include schematic illustrations of a protective system, according to one set of embodiments.

Articulating protective systems for resisting mechanical loads and related methods are generally described. The protective systems described herein can incorporate one or more features that enhance the ability of the structure to resist an applied force while remaining sufficiently flexible to allow for movement of the object or person the structure is designed to protect. In some embodiments, the protective systems can include multiple load-resistant units arranged to form a plurality of rows. The load-resistant units within a given row can each include a thickened central region where a protrusion and/or an indentation are located. In some instances, load-resistant units within a row can be interconnected by arranging the protrusion of a first unit such that it is housed within an indentation (which can form a socket of a peg-and-socket connection) of a first adjacent unit to form a peg-and-socket connection. In addition, in some cases, the first unit can include an indentation into which a protrusion from a second adjacent unit (e.g., on the opposite side of the first unit as the first adjacent unit) can be fit. The peg-and-socket connection can stiffen the protective system anisotropically along the direction of the row. The peg-and-socket connection between adjacent units within a row can be reinforced, for example, by adhering a material (e.g., a compliant fiber array) between the joined units within the peg-and-socket joint. The range of motion of a given peg-and-socket joint can be determined by both the geometry of the peg-and-socket and the properties of the compliant fiber array. In some embodiments, the peg-and-socket joint can include a graded geometry that can minimize stress concentrations.

In some cases, at least some of the plurality of rows can be arranged such that they overlap an adjacent row. Neighboring rows of load-resistant units can be constructed and arranged to slide relative to each other. In some embodiments, the overlapping rows can exhibit enhanced compliance relative to the peg-and-socket row directions. Accordingly, the articulating protective system can be more flexible along the direction perpendicular to the rows of load-resistant units, relative to the flexibility of the system in the direction parallel to the rows of load-resistant units. In some cases, the ability of the units to slide relative to each other and/or the cross-sectional geometry of the individual load-resistant units can enable a relatively constant thickness (and, hence, load resistance) to be maintained as the protective system is flexed.

One or more layers of flexible material can be positioned underneath the assembly of load-resistant units, in some cases. The layer(s) of flexible material can be connected to the unit assembly (e.g., at their centrally thickened locations) to maintain the units in their desired positions. In addition, the layer(s) of flexible material can provide enhanced load resistance, in some cases.

As used herein, the phrase "mechanical load" is given its ordinary meaning in the art, and refers to an applied force that is at least partially supported by a body or structure (e.g., the load resisting structure such as the protective systems described herein). A mechanical load can be exerted, for example, via pressure, weight, or an interaction with another object. Exemplary sources of mechanical loads include, but are not limited to explosions (e.g., via debris, shockwave, etc.), collisions (with a stationary object such as the ground or with a moving object such as a bullet, a moving vehicle, a moving person, etc.), static forces (e.g., a force applied upon stacking an object on a load resistant article), pressurized atmospheres, and the like.

In some instances, the protective systems and articles described herein can be non-naturally occurring. As used herein, a "non-naturally occurring" article refers to an article that is synthesized, treated, fabricated, or otherwise manipulated. That is, the non-naturally occurring article may have a structure (e.g., chemical structure, shape, size, etc.) or may exhibit properties not present in the material or material precursor prior to synthesis, treatment, fabrication, or other manipulation. In some cases, the material may be synthesized, treated, fabricated, and/or otherwise manipulated in a laboratory and/or manufacturing setting. In some cases, a non-naturally occurring article can comprise a naturally-occurring material that is treated, processed, or manipulated to exhibit properties that were not present in the naturally-occurring material, prior to treatment.

Figure 1B:
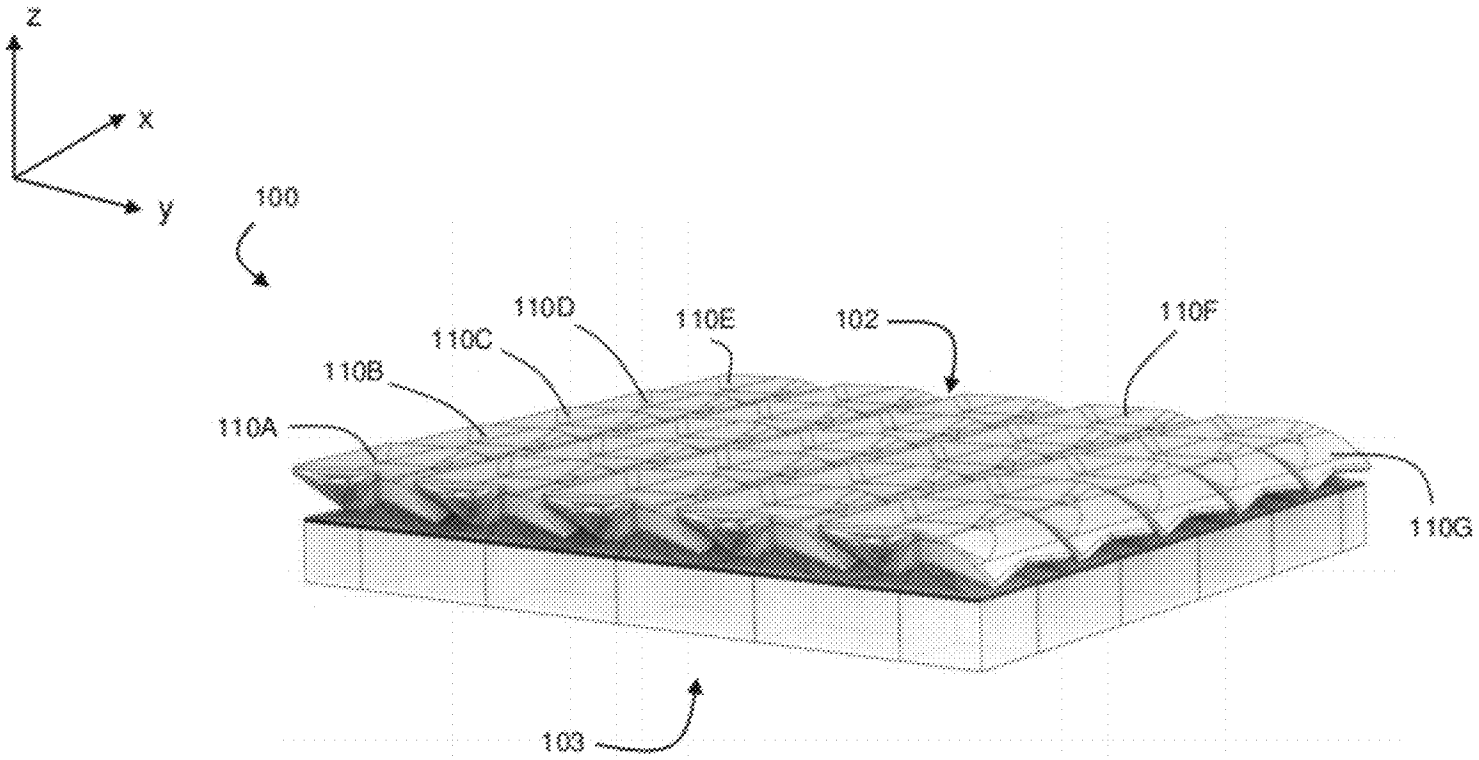
Figure 1C:
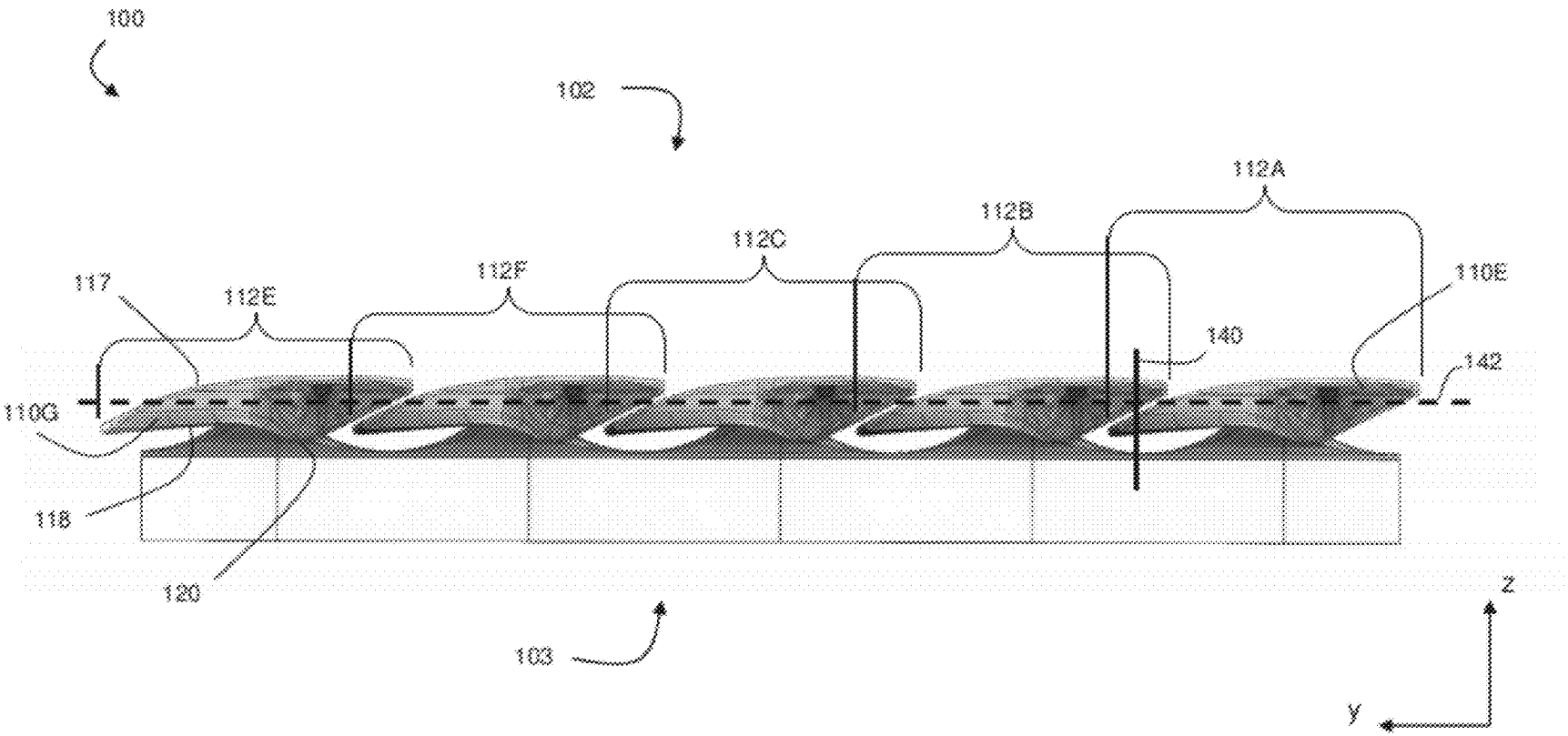

FIGS. 1A-1C include exemplary schematic illustrations of a portion 100 of an articulating protective system for resisting a mechanical load. Portion 100 includes an exposed side 102, which can correspond to the side that is configured to be exposed to the outside environment when the protective system is positioned proximate to the person or object it is designed to protect. In addition, portion 100 includes an interior side 103, which can be configured to correspond to the side that faces the protected person or object when the protective system is positioned proximate to the person or object it is designed to protect. FIG. 1A includes a view of portion 100 from the interior side 103. FIG. 1B includes a view of portion 100 illustrating the exposed side 102. FIG. 1C includes a side view of portion 100 along edge 101.

The articulating protective system can include a plurality of load-resistant units, which can be constructed and arranged to provide load resistance over a relatively large area compared to the area covered by a single load-resistant unit. As used herein, a "load-resistant unit" is a unit that, by itself, can resist loads of the type for which the invention is designed to protect, without fracture or other damage that would impede its ability to function and, preferably, to resist further loads. Such a unit also interacts with other such units to, together, resist loads of the type the invention is designed to receive and absorb, without significant disruption of interactions and/or arrangements between such units in a way that would impede the units, together, to resist further loads.

Figure 9A:
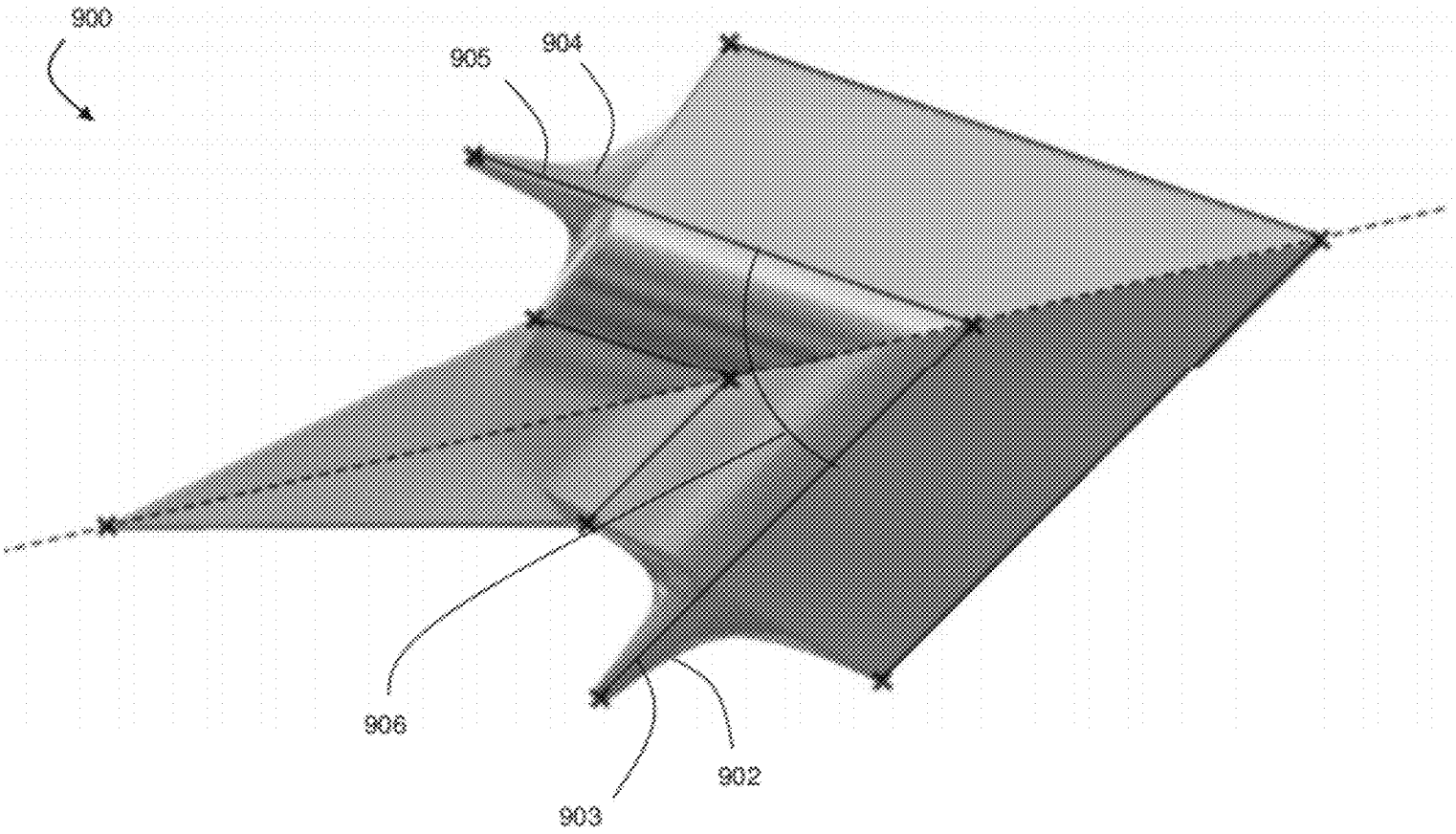
FIGS. 9A-9C include schematic illustrations of (A) a load-resistant unit and (B-C) a system comprising the load resistant unit in FIG. 9A, according to one set of embodiments.

In the set of embodiments illustrated in FIG. 1A, portion 100 includes a plurality of load-resistant units 110 (including units 110A-G) arranged to protect a relatively large area. In FIG. 1A, load-resistant units 110 are substantially similar in size and shape (and, in some cases, can be the same size and/or shape). In some embodiments, however, one or more load-resistant units 110 can have a different size (e.g., in a direction along the x-y plane in FIGS. 1A-1C, such as along the x- and/or y-coordinates) and/or shape than the other load-resistant units within the article. The use of load-resistant units with varying sizes and/or shapes can be useful, for example, to cover an irregular geometry and/or impart a desired flexibility. In some embodiments, the size (e.g., in an in-plane direction, such as along the x-y plane in FIGS. 1A-1C) and/or shape of the load-resistant units can be configured to impart a desired flexibility to at least a portion of a protective article. For example, in some embodiments, relatively small units can be positioned within one or more portions of the protective article to allow those portions to flex more easily. In areas where less flexibility is needed, relatively large units can be employed. In some embodiments, the size (e.g., in an in-plane direction, such as along the x-y plane in FIGS. 1A-1C) and/or shape of the load-resistant units can be configured to accommodate the geometry of the article that is to be protected (e.g., to cover a non-planar surface of an article that is being protected). For example, in some embodiments, relatively small units can be employed to cover a geometry that is relatively highly curved. In some embodiments, relatively large units can be used to cover relatively flat areas. As another example, individual units can be contoured to cover a corner, edge, or other irregularly shaped portion of the protective article. For example, unit 900 in FIG. 9A is configured to cover a corner of a protective article.

The load-resistant units can be arranged to form a plurality of rows. For example, in FIG. 1A, units 110A-E are arranged side-by-side to form row 112A. In addition, portion 100 includes rows 112B, 112C, 112D, and 112E, each formed by arranging 5 load-resistant units in a side-by-side manner. It should be understood that the protective system can include any suitable number of rows, each row containing any suitable number of load-resistant units. One of ordinary skill in the art, given the present disclosure, would be capable of selecting a number of rows and/or units per row to achieve a desired coverage.

Each of the load-resistant units in the articulating protective system can be made of any suitable material including, but not limited to, a polymer (e.g., Kevlar®, polyethylene, polypropylene, polyester, and polyamide), a metal (e.g., titanium, aluminum), a ceramic (e.g., alumina, boron carbide), carbon (e.g., carbon fiber composite), or a combination of two or more materials from one or more of these categories. In some embodiments, one or more load-resistant units can be formed of a substantially rigid, shape-retaining material (e.g., hard plastics, metals, ceramics, composites, etc.). In some embodiments, one or more of the load-resistant units can be a heterogeneous composite. For example, one or more of the load-resistant units can include a carbon fiber composite, a carbon nanostructure composite (e.g., carbon nanotube composite), and/or a ceramic composite. In some cases, a load-resistant unit can comprise a multi-layered material. The load-resistant units can include, in some cases, internal porosity, which might, for example, reduce the weight of the load-resistant unit while maintaining its ability to resist mechanical loads.

In some embodiments, the load-resistant units can include a protrusion and/or an indentation. The load-resistant units within a row can be interconnected, in some cases, by arranging a protrusion of a first unit such that it is housed within an indentation of a first adjacent unit to form a peg-and-socket connection. For example, in the set of embodiments illustrated in FIG. 1A, load-resistant unit 110D can include a protrusion that is configured to fit into an indentation within load-resistant unit 110C at peg-and-socket connection 114. One of ordinary skill in the art would be familiar with a peg-and-socket connection. The peg-and-socket connection between load-resistant unit 110D and load-resistant unit 110C can allow for the two units to move relative to each other. For example, unit 110D can be rotated around the longitudinal axis of its protrusion relative to unit 110C. In addition, the angle between units 110C and 110D can be changed by bending unit 110D (and/or unit 110C), for example, along the x-axis in FIG. 1A.

In some instances, the first load-resistant unit can include an indentation into which a protrusion from a second adjacent unit can be fit. For example, in FIG. 1A, load-resistant unit 110D can include an indentation into which a protrusion from load-resistant unit 110E can be fit at peg-and-socket connection 116. In some cases, the second adjacent unit can be on the opposite side of the first unit as the first adjacent unit, in which case, the three units can form a row. In FIG. 1A, load-resistant units 110E and 110C are on opposite sides of load-resistant unit 110D, thereby forming a portion of a row of load-resistant units. Load-resistant units including protrusions and indentations can be arranged to form a row of any suitable length. For example, in FIG. 1A, load-resistant unit 110C includes a protrusion constructed and arranged to be fit into an indentation in unit 110B, and unit 110B includes a protrusion constructed and arranged to be fit into an indentation in unit 110A, thus producing a row with five interconnected load-resistant units.

Figure 5:
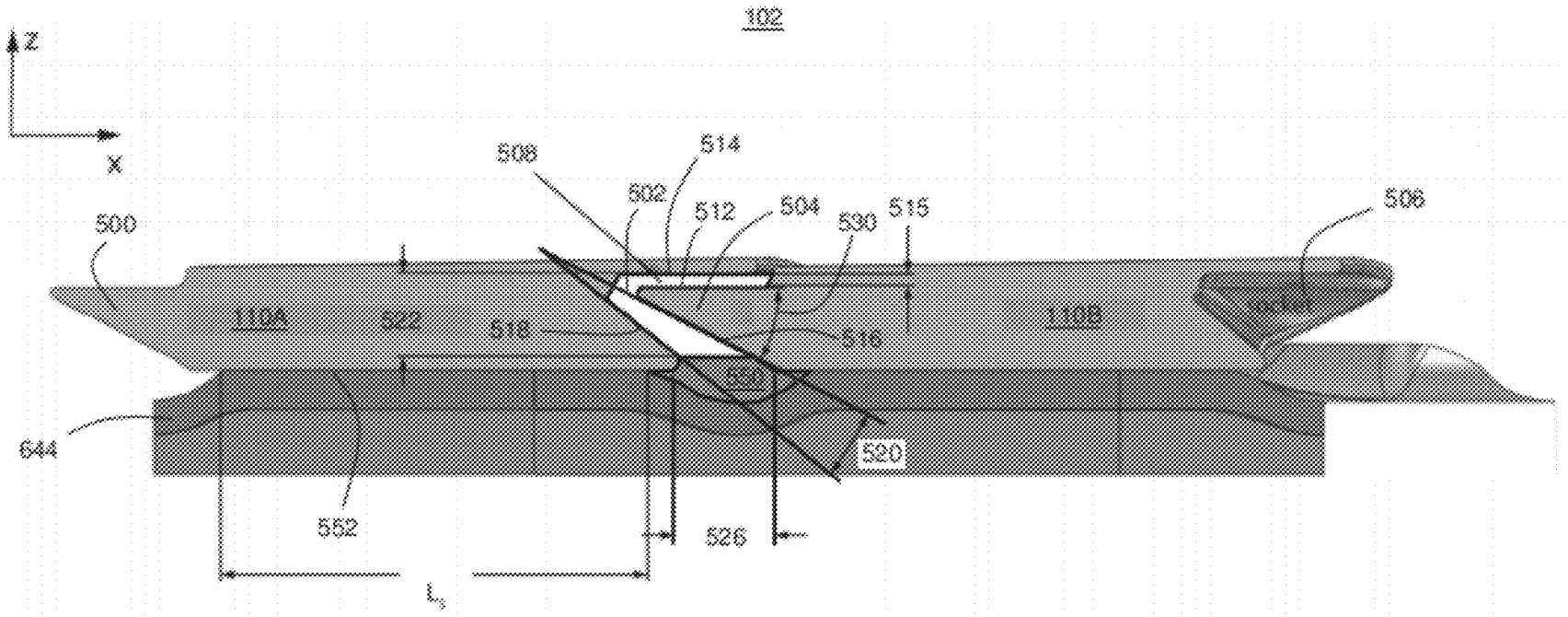
FIG. 5 includes an exemplary schematic illustration of a pair of load-resistant units arranged to form a peg-and-socket connection, according to some embodiments.

For purposes of clarity, the protrusions and indentations in the load-resistant units are not shown in FIGS. 1A-1C. FIG. 5 includes an exemplary cross-sectional schematic illustration of the peg-and-socket interconnection between units 110A and 110B in FIG. 1A. The cross-sectional illustration in FIG. 5 corresponds to the cross-sectional view perpendicular to the plane defined by portion 100 that includes line 125. In the set of embodiments illustrated in FIG. 5, load-resistant unit 110A includes protrusion 500 and indentation 502. In addition, load-resistant unit 110B includes protrusion 504 and indentation 506. Protrusion 504 of unit 110B is arranged such that it lies within indentation 502 of unit 110A.

In some embodiments, the peg-and-socket connection between adjacent load-resistant units within a row can be reinforced. Reinforcement can be accomplished, for example, by positioning a material (e.g., a solid adhesive, a flexible array of fibers, etc.) such that it connects at least a portion of the protrusion of one unit and at least a portion of the indentation of an adjacent unit. In some embodiments, the material can be adhered between a protrusion and an adjacent indentation. For example, in the set of embodiments illustrated in FIG. 5, intra-socket material 508 is positioned between units 110A and 110B. The range of motion of a given peg-and-socket joint can be controlled, in some cases, by choosing an intra-socket material with a pre-determined elasticity. One of ordinary skill in the art would be capable of determining an appropriate inter-socket material to achieve the desired adhesive strength and/or elasticity between multiple load-resistant units. In some cases, the presence of the material within a peg-and-socket connection can stiffen the protective system anisotropically along the direction of the row.

In some embodiments, when the protective system is not exposed to a mechanical load (i.e., when the protective article is in its default, unstressed position), the space between the protrusion of a first unit and the indentation of an adjacent unit within a peg-and-socket connection can be relatively small. For example, in some cases, at least one pair (or at least a majority of the pairs) of the load-resistant units can be spaced such that the average distance between the protrusion and the indentation within a peg-and-socket connection is less than about 0.5, less than about 0.1, between about 0.01 and about 0.5, or between about 0.01 and about 0.1 times the average of the maximum cross-sectional dimensions of the units joined by the peg-and-socket connection. The average distance between a protrusion and an adjacent indentation can be calculated by determining the distances between the protrusion and the nearest point on the surface of the indentation at each point on the protrusion and averaging the resulting numbers. In addition, the "maximum cross-sectional dimension" of an article (e.g., a load-resistant unit) is the largest dimension that can be measured between two points on the exterior surface of the article. For example, in FIG. 4A, the maximum cross-sectional dimension of unit 110 is illustrated by dimension 410. The average of the maximum cross-sectional dimensions of multiple articles is calculated as the number average.

In some cases, a load-resistant unit can have a maximum cross-sectional dimension of at least about 1 mm, at least about 1 cm, at least about 10 cm, at least about 1 meter, between about 1 mm and about 10 meters, between about 1 mm and about 1 meter, between about 1 cm and about 10 meters, or between about 1 cm and about 1 meter. In some cases, the average of the maximum cross-sectional dimensions of the load-resistant units within a protective system can be at least about 1 mm, at least about 1 cm, at least about 10 cm, at least about 1 meter, between about 1 mm and about 10 meters, between about 1 mm and about 1 meter, between about 1 cm and about 10 meters, or between about 1 cm and about 1 meter.

When the protective system is not exposed to a mechanical load, one or more surfaces of the protrusion can be angled relative to the surface of the indentation in which it is positioned. For example, in the set of embodiments illustrated in FIG. 5, surface 516 of protrusion 504 is angled relative to surface 518 of indentation 502, illustrated as angle 520. In some cases, at least one pair (or at least a majority of the pairs) of the load-resistant units can be spaced such that the average angle between the surface of the protrusion and the surface of the adjacent indentation can be between about 0° and about 50°.

In some cases, when the protective system is not exposed to a mechanical load, the surface of the protrusion closest to the exposed side of the articulating protective system can be substantially parallel to the adjacent surface of the indentation in which the protrusion is located. For example, in FIG.

5 surface 512 is substantially parallel to surface 514. In some such embodiments, at least one pair (or at least a majority of the pairs) of the load-resistant units can be spaced such that the distance between the surface of the protrusion closest to the exposed side of the articulating protective system and the adjacent surface of the indentation in which the protrusion is located (indicated by dimension 515 in FIG. 5) can be less than about 0.5, less than about 0.1, or between about 0.01 and about 0.1 times the average of the maximum cross-sectional dimensions of the units joined by the peg-and-socket connection(s). In addition, in some cases in which the surface of the protrusion closest to the exposed side of the articulating protective system is substantially parallel to the adjacent surface of the indentation in which the protrusion is located, all other surfaces of the protrusion can be substantially parallel to or angled relative to the adjacent surface of the indentation in which the protrusion is located (e.g., having an angle between about 0° and about 50°, such as angle 520 in FIG. 5), when the protective system is not exposed to a mechanical load.

The distance between the load-resistant units along the length of the row (i.e., along the x-axis in FIGS. 1A-1C and in FIG. 5) can be relatively small along the surfaces of the units closes to the interior side of the protective system, in some embodiments. For example, when the protective system is not exposed to a mechanical load, at least one pair (or at least a majority of the pairs) of the load-resistant units can be spaced such that the average distance between the surfaces of load-resistant units closest to interior side 103 of the protective system within a row (as indicated, for example, by dimension 526 in FIG. 5) can be between about 0.05 and about 0.2 times the average of the maximum cross-sectional dimensions of the units joined by the peg-and-socket connection.

The protrusions described herein can have a variety of geometries. One or more dimensions of a protrusion can be selected such that the protrusion can provide sufficient structural support within the peg-and-socket joint between adjacent load-resistant units. In some cases, the length of a protrusion (or the lengths of a majority of the protrusions within the protective system) can be between about 0.05 and about 0.3 times the maximum cross-sectional dimension of the load-resistant unit from which the protrusion extends. The length of a protrusion corresponds to the length of the longitudinal axis of the protrusion. As used herein, the term "longitudinal axis" of an article (e.g., a protrusion, an indentation, etc.) spans the geometric center of the cross-section of the base of the article and the geometric center of the cross-section of the tip of the article. One of ordinary skill in the art would understand the term geometric center and how to measure the geometric center of the cross-sections of the base and the tip of an article such as a protrusion or an indentation. In some embodiments, the longitudinal axis of a protrusion and/or an indentation may be a substantially straight line. For example, in the set of embodiments illustrated in FIG. 7, the protrusion includes longitudinal axis 710 with a length indicated as dimension 716.

Figure 7:
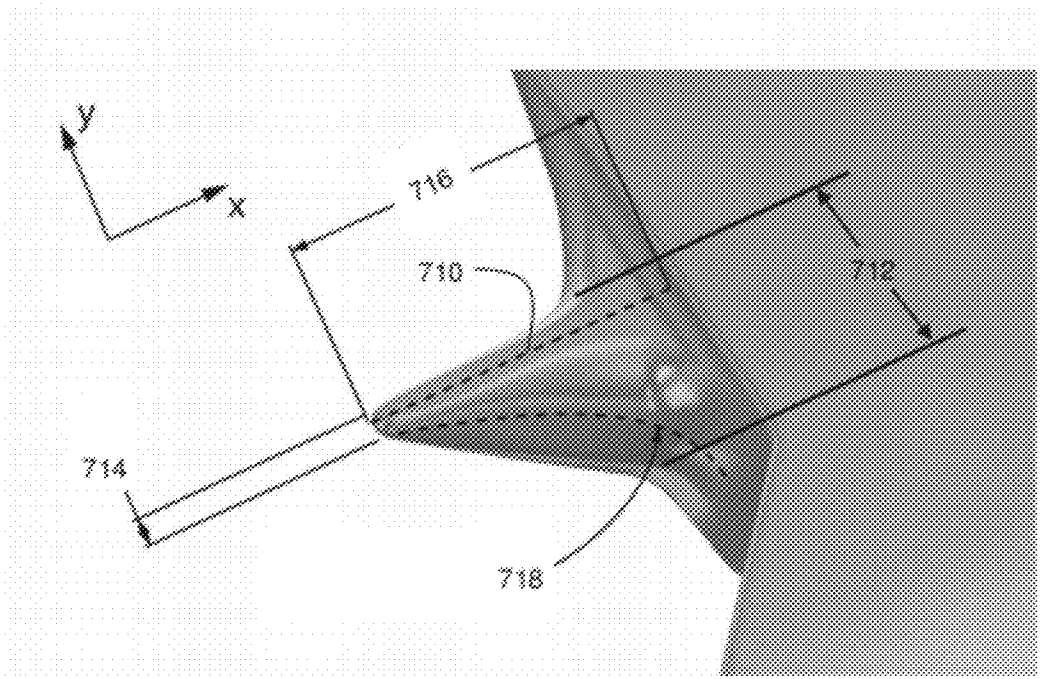
FIG. 7 includes, according to one set of embodiments, a schematic illustration of a protrusion.

In some embodiments, one or more of the plurality of protrusions can be tapered (e.g., along its longitudinal axis, in a direction perpendicular to its longitudinal axis). Not wishing to be bound by any particular theory, the use of a tapered protrusion might reduce stress concentration within the volume of the protrusion, relative to an amount of stress concentration that might be observed in a non-tapered protrusion in a peg-and-socket connection. FIG. 7 includes an exemplary schematic illustration of a tapered protrusion that can be used as part of a peg-and-socket connection.

Protrusion(s) can be tapered to any suitable degree. For example, in some embodiments, the protrusions can be tapered such that the tip of the protrusions are substantially pointed. In other cases, a tip of a protrusion can include a substantially smooth, flat surface with a relatively large surface area (e.g., at least about 10%, at least about 20%, at least about 30%, at least about 40%, or more of the cross-sectional surface area at the base of the protrusion).

A protrusion tapered along its longitudinal axis can have any suitable taper angle. Generally, the taper angle of a protrusion refers to the angle formed by the external surfaces of the protrusion within a cross-section of the protrusion taken through its longitudinal axis. In some embodiments, the taper angle of a protrusion may vary depending on the orientation of the cross-section through the longitudinal axis and/or location along the longitudinal axis of the protrusion. In such cases, the protrusion may have a maximum taper angle and a minimum taper angle. In some embodiments, a protrusion (or a plurality of protrusions) can have a taper angle, a maximum taper angle, or a minimum taper angle (or an average of the taper angles, maximum taper angles, and/or minimum taper angles) of between about 3° and about 75°, between about 3° and about 60°, between about 3° and about 45°, between about 3° and about 30°, or between about 3° and about 15°. In some cases, the taper angle of the protrusion along a plane that is substantially parallel to the x- and z-axes of the protective system is between about 25° and about 60°. This angle is illustrated as angle 530 in FIG. 5.

In some cases, the thickness of the protrusion at its base (or the thicknesses of a majority of the protrusions at their bases within the protective system) can be between about 0.01 and about 0.5 times the maximum-cross sectional dimension of the load-resistant unit from which the protrusion extends. In some instances, the average of the thicknesses of a plurality of protrusions at their bases can be between about 0.01 and about 0.5 times the average of the maximum cross-sectional dimensions of the plurality of protrusions. Generally, the thickness of a protrusion at its base is measured as the maximum cross-sectional dimension of the protrusion at its base, as measured perpendicular to the longitudinal axis of the protrusion. In the set of embodiments illustrated in FIG. 7, dimension 712 corresponds to the thickness of the protrusion at its base.

In some cases, the thickness of the protrusion at its tip (or the thicknesses of a majority of the protrusions at their tips within the protective system) can be between about 0.01 and about 0.07 times the maximum-cross sectional dimension of the load-resistant unit from which the protrusion extends. In some cases, the average of the thicknesses of a plurality of protrusions at their tips can be between about 0.01 and about 0.07 times the average of the maximum cross-sectional dimensions of the plurality of protrusions. The thickness of a protrusion at its tip is measured as the maximum cross-sectional dimension of the protrusion at its tip, as measured perpendicular to the longitudinal axis of the protrusion. In the set of embodiments illustrated in FIG. 7, dimension 714 corresponds to the thickness of the protrusion at its tip.

A protrusion can include one or more curved surfaces, in some embodiments. Not wishing to be bound by any particular theory, the curved surface(s) can allow for relatively free movement of the protrusion relative to an adjacent indentation. In some cases, the protrusion can include a surface with a radius of curvature that is between about 0.01 and about 0.1 times the maximum-cross sectional dimension of the load-resistant unit from which the protrusion extends. The protrusion illustrated in FIG. 7 includes curved portion 718. In some cases, the protrusion can include a substantially planar surface facing the exposed side of the protective system and one or more curved portions (which can have radii of curvature within the ranges outlined above) within surfaces facing the interior side of the protective system.

Figure 8A:
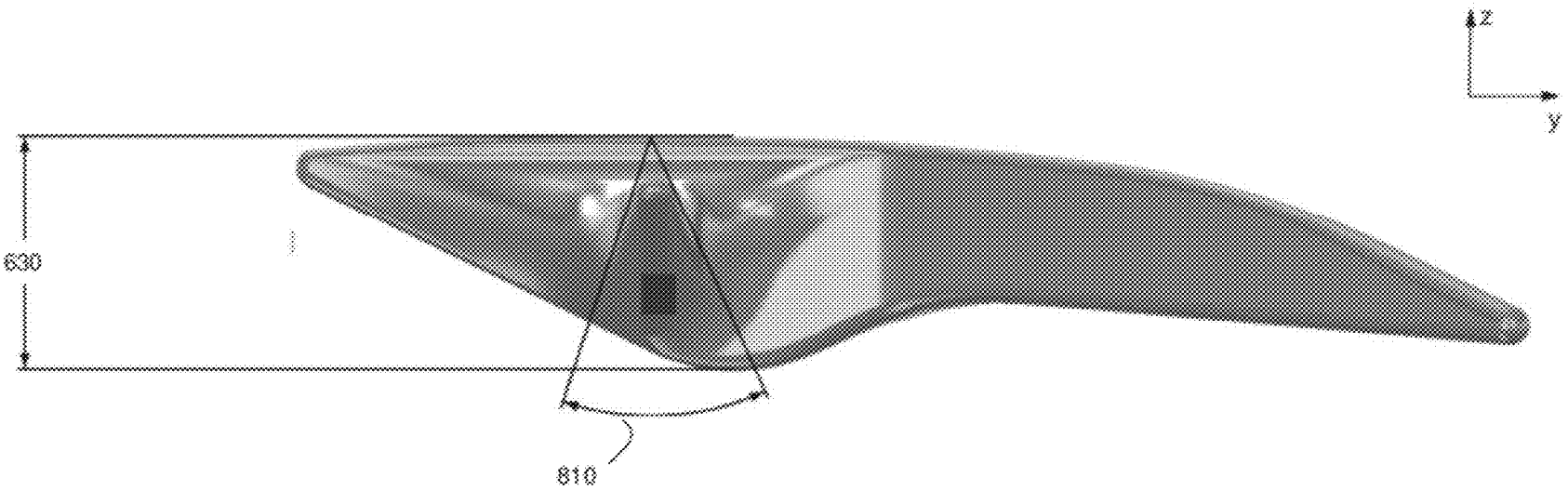
FIGS. 8A-8B include schematic illustrations of a load-resistant unit, according to some embodiments.

A protrusion can be tapered, in some cases, in a direction substantially perpendicular to its longitudinal axis. In some embodiments, the protrusion can be tapered such that the protrusion is relatively narrow at the portion closest to the exposed side of the protective system and relatively wide at the portion closest to the interior side of the protective system. Tapering the protrusion in this manner can allow for relatively easy movement of adjacent load-resistant units within rows. Protrusions tapered in this manner are said to have transverse taper angles. Generally, the transverse taper angle of a protrusion refers to the angle formed by the external surfaces of the protrusion within a cross-section of the protrusion taken substantially perpendicularly to its longitudinal axis. In some embodiments, the transverse taper angle of a protrusion (as illustrated, for example, as angle 810 in FIG. 8A) can be between about 30° and about 100°.

Figure 8B:
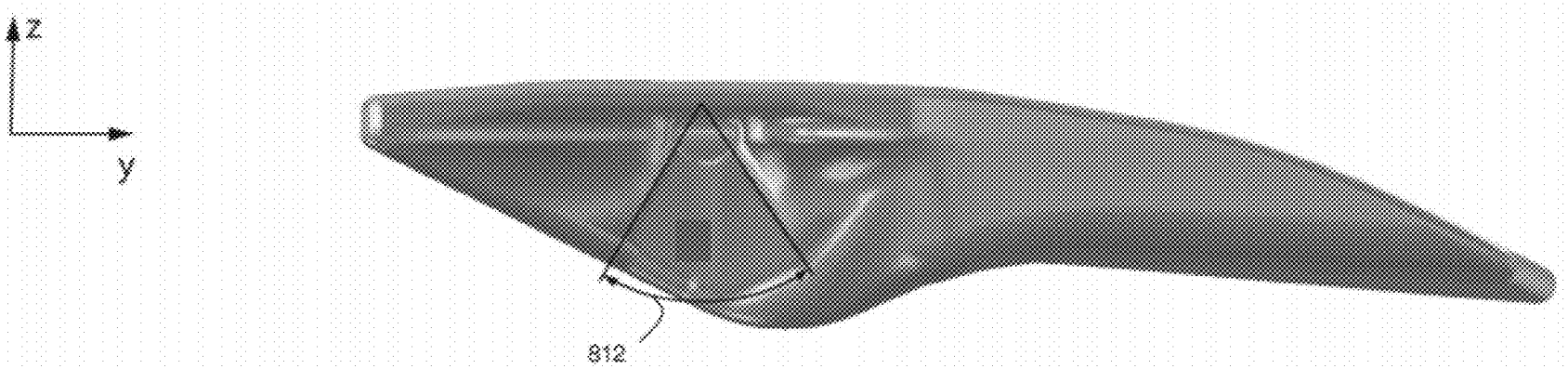

The indentations described herein can also have any suitable shape. The indentations can, in some cases, be shaped such that they are sufficiently large to house a protrusion from an adjacent load-resistant unit, for example, to form a peg-and-socket connection. In some cases, the depth of the indentation (as measured along the longitudinal axis of the indentation) can be between about 0.05 and about 0.3 times the maximum cross-sectional dimension of the load-resistant unit in which the indentation is formed. The indentations can also be tapered (e.g., along their longitudinal axes and/or transverse to their longitudinal axes), in some cases. In some cases, the indentation can include a transverse taper angle (as illustrated, for example, as angle 812 in FIG. 8B) of between about 30° and about 120°, in some cases. The transverse taper angle of an indentation can, in some cases, be larger than the transverse taper angle of an adjacent protrusion.

In some embodiments, the height of an indentation (or the average height of multiple indentations) can be between about 0.05 and about 0.2 times the maximum cross-sectional dimension of the load-resistant unit in which the indentation is formed (or the average maximum cross-sectional dimension of multiple load-resistant units). The height of an indentation is measured as the maximum distance between two points on the surface of the indentation that lie within a line substantially perpendicular to the exposed surface of the load-resistant unit in which the indentation is formed. For example, the height of indentation 502 in FIG. 5 is given by dimension 522.

In some cases, at least some of the plurality of rows of load-resistant units can be arranged such that they at least partially overlap an adjacent row. Two units or rows within a are said to overlap if a line substantially perpendicular to a surface defined by the centers of mass of each of the load-resistant units within the protective system (e.g., a surface perpendicular to the page and including line 142 in FIG. 1C) intersects the two units or rows (e.g., as with line 140 in FIG. 1C). For example, in the set of embodiments illustrated in FIGS. 1A-1C and FIG. 6, rows 112A and 112B, rows 112B and 112C, rows 112C and 112D, and rows 112D and 112E overlap.

In some embodiments, the load-resistant units in adjacent, overlapping rows can move relative to each other. The ability of the adjacent rows to move relative to each other can provide enhanced flexibility, relative to the flexibility between load-resistant units joined by peg-and-socket connections. Accordingly, in some cases, the articulating protective system can be more flexible along a direction perpendicular to the rows of load-resistant units (e.g., along the y-axis in the figures), relative to the flexibility of the system in the direction parallel to the rows of load-resistant units (e.g., along the x-axis in the figures).

The geometries of the load-resistant units can be chosen, in some embodiments, such that the thickness of the protective system remains relatively constant as the protective system is flexed. The thickness of the protective system corresponds to the distance between the outermost surface of the protective system (e.g., the exposed surfaces of the load-resistant units) and the innermost surface of the protective system (e.g., the interior surfaces of the load-resistant units or the interior surface of a sheet attached to the interior surfaces of load-resistant units), as measured perpendicularly to a surface defined by the centers of mass of each of the load-resistant units within the protective system (e.g., a surface perpendicular to the page and including line 142 in FIG. 1C). In some embodiments, the difference between the thickness of the protective system at any point along the protective system and the average thickness of the protective system is less than about 40%, less than about 30%, less than about 20%, or less than about 10% of the average thickness of the protective system. One of ordinary skill in the art would be capable of determining the average thickness of a protective system by measuring the thickness at a plurality of points and calculating the number average of the values. In some cases, the above-mentioned ranges of thickness consistency can be achieved when the protective system is deformed such that it includes a radius of curvature that is less than about 10,000, less than about 1000, less than about 100, between about 10 and about 10,000, between about 10 and about 1000, between 100 and about 10,000, or between 100 and about 1000 times the average of the longest cross-sectional dimensions of the load-resistant units within the protective system.

Figure 6:
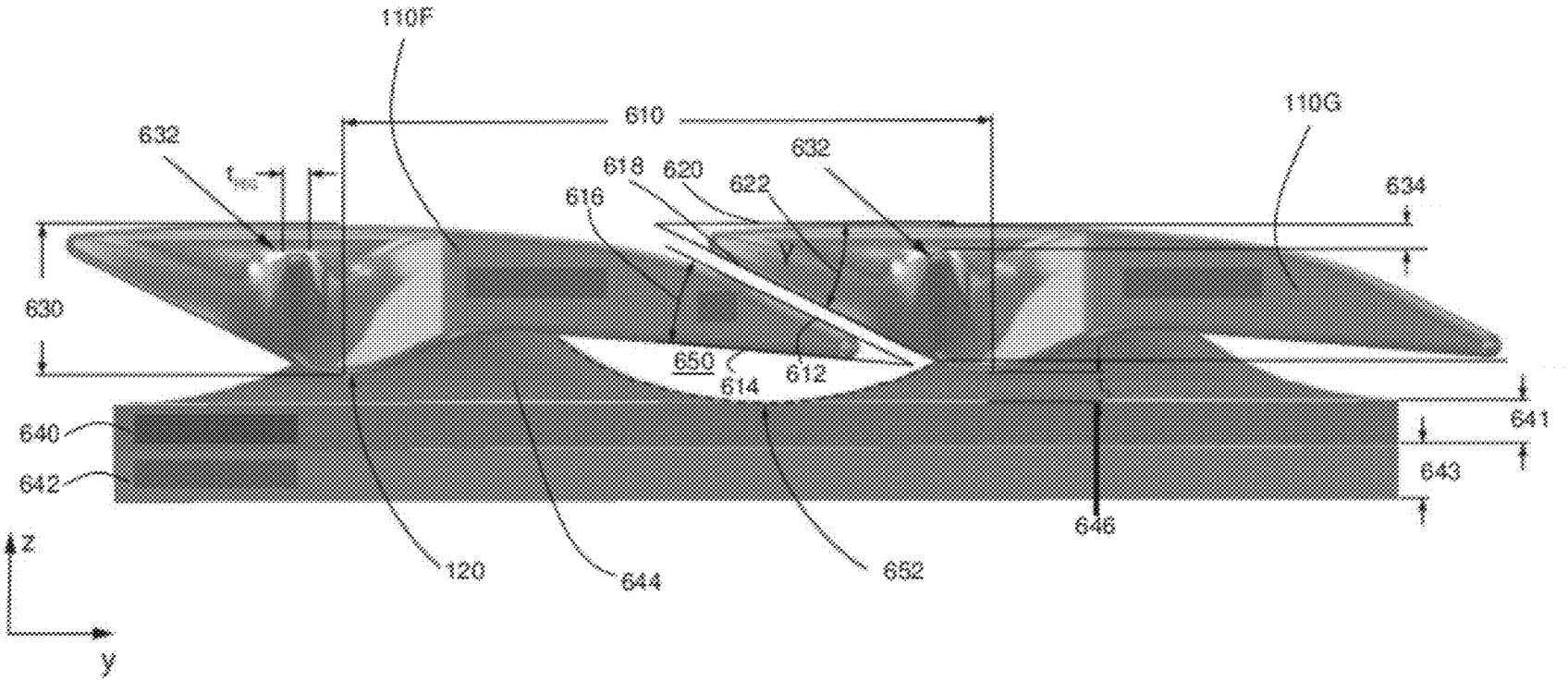
FIG. 6 includes an exemplary schematic illustration of a portion of a protective system, according to some embodiments.

FIG. 6 includes an exemplary cross-sectional schematic illustration of the overlap between rows 112D and 112E in FIG. 1A. The cross-sectional illustration in FIG. 5 corresponds to the cross-sectional view perpendicular to the plane defined by portion 100 that includes line 130.

The plurality of rows can be spaced relatively closely, in some cases. In some embodiments, two adjacent rows of load-resistant units can be arranged such that an intra-unit separation distance between two adjacent rows (or an average of the intra-unit separation distances between two adjacent rows) can be between about 0.7 and about 1.1 times the average of the maximum cross-sectional dimensions of the load-resistant units within the rows. The intra-unit separation distance is defined as the y-axis component of the distance between corresponding points on adjacent load-resistant units. For example, in the set of embodiments illustrated in FIG. 6, the intra-unit separation distance corresponds to dimension 610. In the set of embodiments illustrated in FIGS. 1A-1C and FIG. 6, the load-resistant units are illustrated as being aligned with each other such that the boundaries of the units parallel to the y-axis align with each other. If, however, the units were offset along the x-axis such that their boundaries along the y-axis were staggered, their intra-unit separation distances would be the same because the intra-unit separation distance includes only the y-axis component of the distance between corresponding points between adjacent units.

In some cases, the exterior surfaces of the overlapping portions of a first and second load-resistant unit can be angled. For example, in the set of embodiments illustrated in FIG. 6, the exterior surfaces 612 and 614 of unit 110F define angle 616, which can be between about 20° and about 70°. In addition, exterior surfaces 618 and 620 of unit 110G define angle 622, which can also be between about 20° and about 70°. In some cases, angles 616 and 622 can be substantially similar.

The load-resistant units can have any suitable shape. In some embodiments, the exposed side of the load-resistant unit can include a convex curvature. Not wishing to be bound by any particular theory, the convex curvature of the exposed side may help disperse the force of load, and enhance the load resistance of the system. Referring back to the set of embodiments illustrated in FIG. 1C, load-resistant unit 110G includes a convex-curved surface 117 on exposed side 102. The convex-curved exposed surface can be shaped, in some cases, such that the cross-section is substantially similarly shaped along an axis of the unit. For example, in the set of embodiments illustrated in FIGS. 1A-1C, the exposed surfaces of the load-resistant units are not substantially curved along the x-axis. Rather, the exposed surfaces of the load-resistant units are shaped such that their cross-sections substantially parallel to the y- and z-axes are substantially similarly shaped along the x-axis, producing a curvature that resembles a cylinder (as opposed to a sphere). In other embodiments, however, the curvature of the exposed surface of the load resistance units may include a curvature along the x-axis (e.g., when the exposed surfaces of the load-resistant units are substantially spherically curved).

The interior surface of the load-resistant units can also include curvature, in some embodiments. In some cases, the interior surface of the load-resistant unit can include both a convex and a concave curvature. In the set of embodiments illustrated in FIG. 1C, load-resistant unit 110G includes an interior surface with a first portion 118 that includes a concave curvature and a second portion 120 that includes a convex curvature. Not wishing to be bound by any particular theory, the concave curvature of the first portion of the interior surface may enhance the ability of the unit to disperse a load. The convex curvature of the second portion of the interior surface can provide sufficient surface area on the side of the unit to include a protrusion and/or an indentation, which can be useful for producing a peg-and-socket connection between load-resistant units, as is described in more detail below. In some cases, the convex-curved portion of the interior surface of an load-resistant unit can have a radius of curvature that is between about 0.1 and about 0.5 times the maximum cross-sectional dimension of the load-resistant unit.

As with the curvature of the exposed surface, the convex-curved and/or concave-curved portions of the interior surface of the load-resistant units can be shaped such that the cross-section is substantially similarly shaped along an axis of the unit. For example, in the set of embodiments illustrated in FIGS. 1A-1C, the interior surfaces of the load-resistant units are not substantially curved along the x-axis, but rather, are shaped such that their cross-sections substantially parallel to the y- and z-axes are substantially similarly shaped along the x-axis, producing a curvature that resembles a cylinder (as opposed to a sphere). In other cases, however, the curvature of the exposed surface of the load resistance units may include a curvature along the x-axis (e.g., when one or more portions of the exposed surfaces of the load-resistant units include a substantially spherical curvature).

In some cases, the cross-sections of the body of the load-resistance units (i.e., disregarding any protrusions or indentations in the load-resistant units that are used as part of a peg-and-socket connection) can be substantially similarly shaped along an axis. For example, in FIGS. 1A-1C, the cross-sections parallel to the y- and z-axes of the bodies of load-resistant units 110 are substantially similarly shaped along the x-axis. When viewed from exposed side 102, the bodies of the load-resistant units (again, disregarding any peg-and-socket protrusions) shaped in the manner described above can have a substantially rectangular or square shape.

Figure 2:
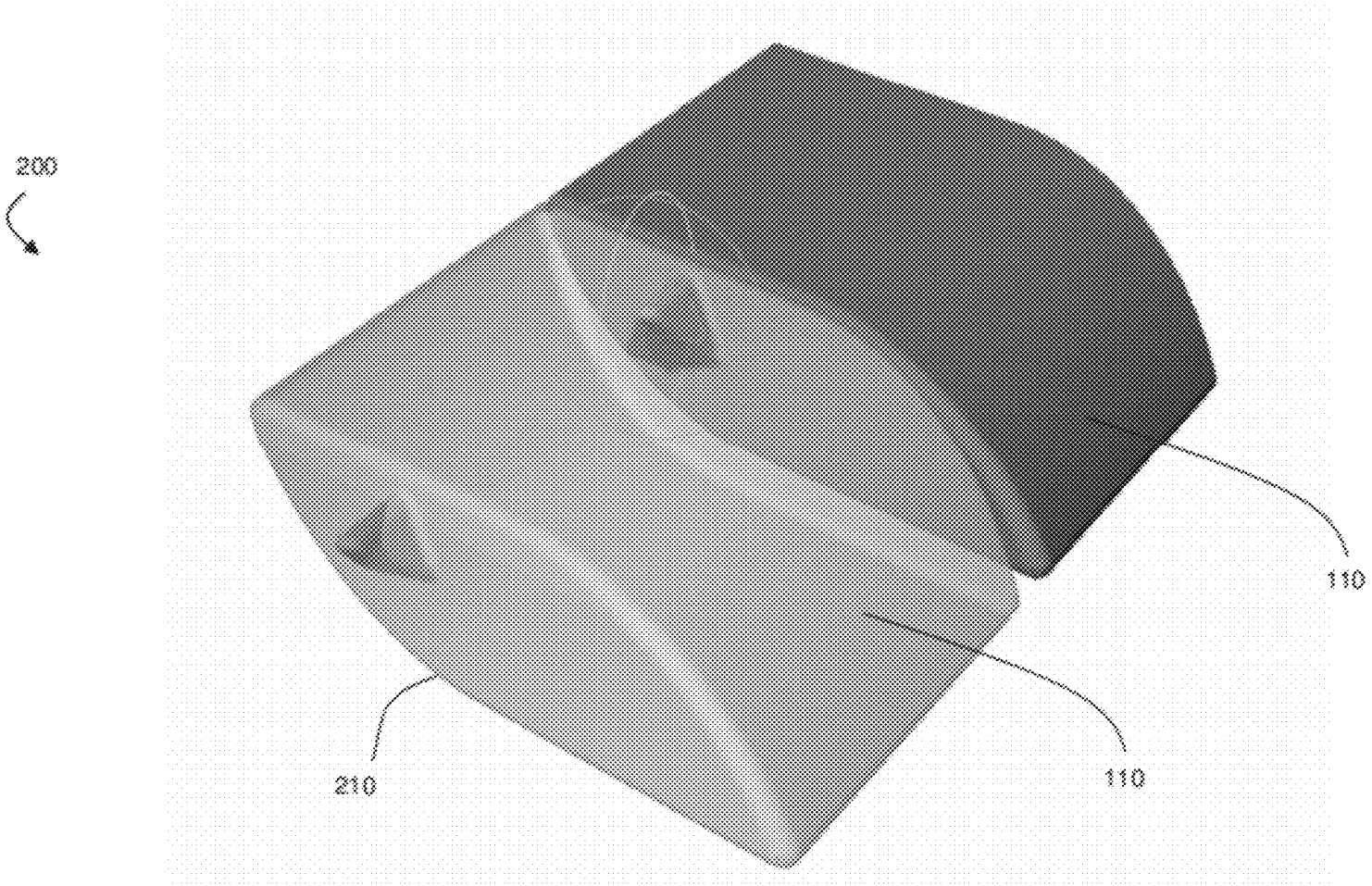
FIG. 2 includes an exemplary schematic illustration of a pair of load-resistant units.

The shape of the load-resistant units is not limited to the embodiments described above. For example, in some cases, the interior surface of the load-resistant units can be substantially free of concave curvature. For example, FIG. 2 includes a schematic illustration of portion 200 in which load-resistant units 110 include interior surfaces 210 that include substantially only convex curvature.

Figure 3A:
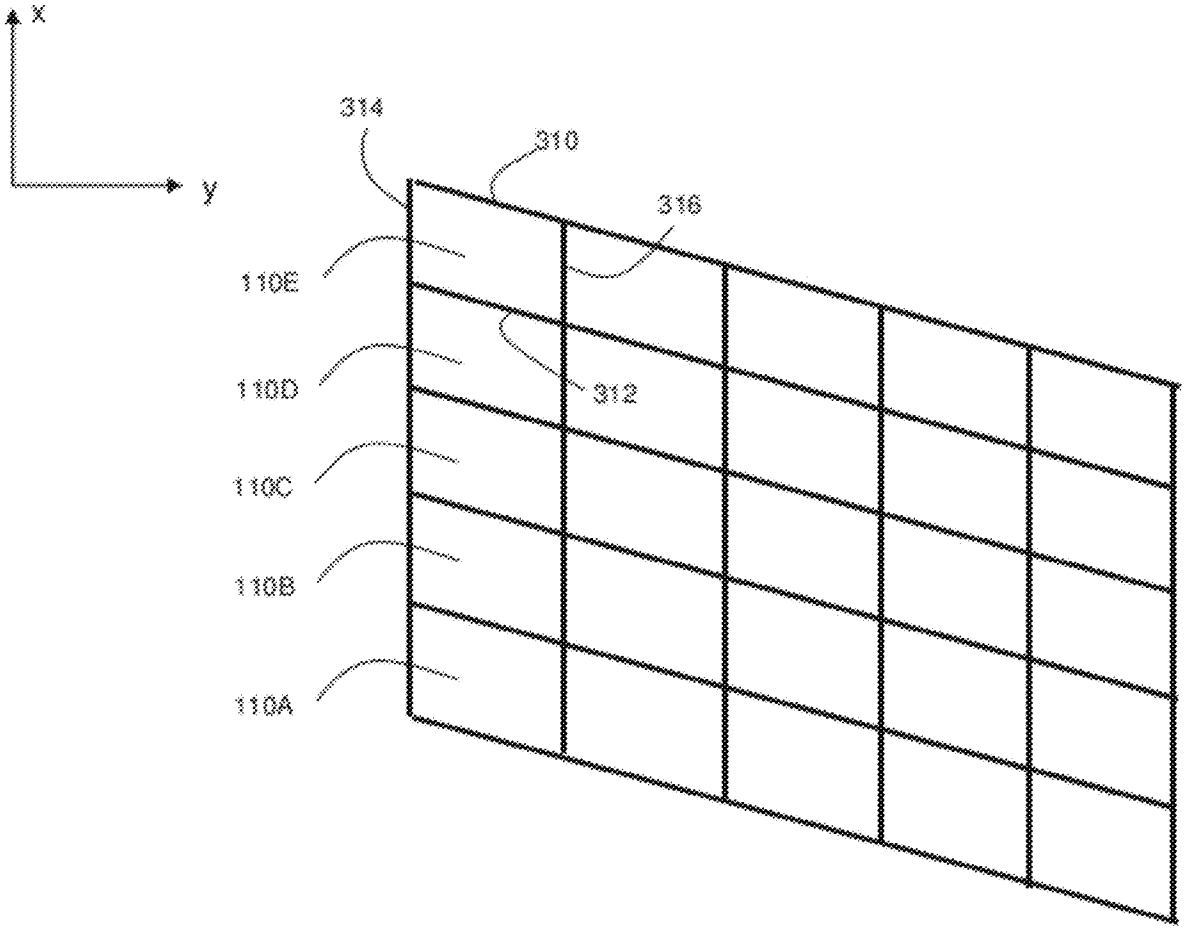
FIGS. 3A-3B include schematic illustrations of exemplary protective systems, according to some embodiments.
Figure 3B:
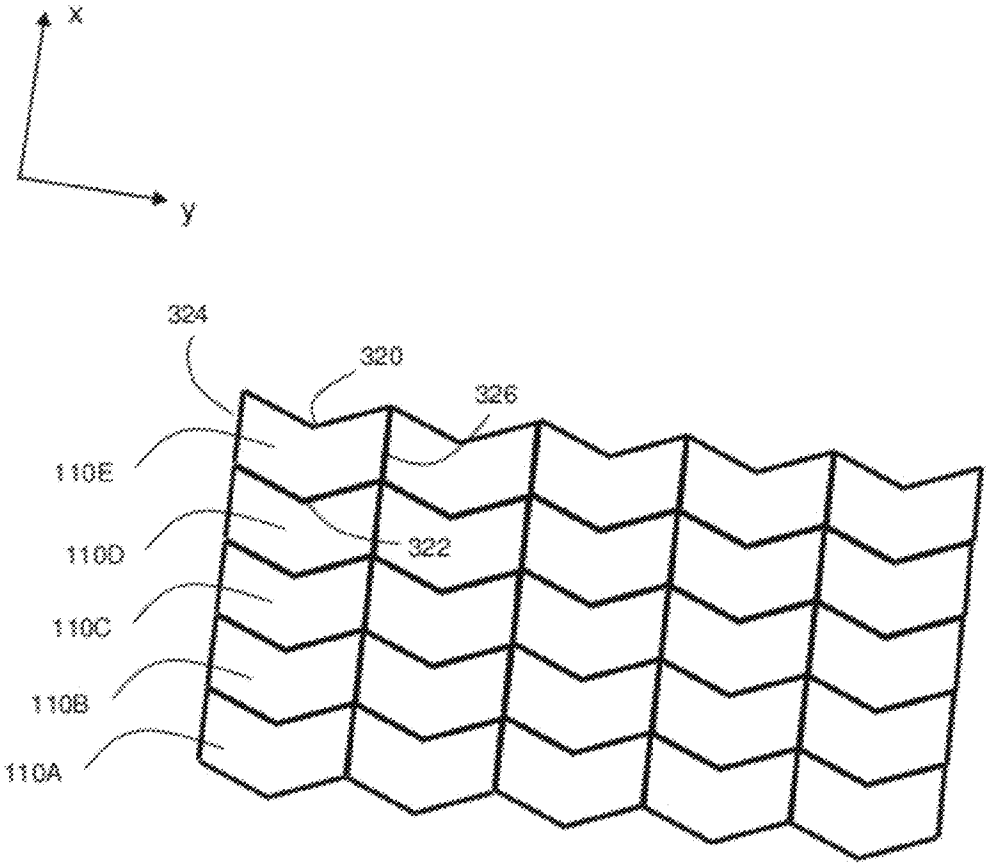

In some embodiments, the bodies of the load-resistant units, when viewed from exposed side 102, can be substantially in the shape of a rhombus, as illustrated in FIG. 3A. In some cases, the bodies of the load-resistant units, when viewed from exposed side 102, can be substantially V-shaped, as illustrated in FIG. 3B. The opposing edges of the load-resistant units can be, in some embodiments, substantially parallel. By arranging the load-resistant units in this way, exposed spaces between the load-resistant units can be reduced. In FIG. 3A, opposing edges 310 and 312 of load-resistant unit 110E are substantially parallel. In addition, opposing edges 314 and 316 of load-resistant unit 110E are substantially parallel. In the set of embodiments illustrated in FIG. 3B, opposing edges 320 and 322 of load-resistant unit 110E are substantially parallel, and opposing edges 324 and 326 of load-resistant unit 110E are substantially parallel.

The load-resistant units described herein can have any suitable thickness. In some cases, the maximum thickness of the load-resistant unit can, in some embodiments, be between about 0.1 and about 0.6 times the maximum cross-sectional dimension of the load-resistant unit. The maximum thickness of an load-resistant unit is measured as the maximum distance perpendicular to the surface defined by the centers of mass of the plurality of load-resistant units that spans the exterior boundaries of the load-resistance unit. For example, in the set of embodiments illustrated in FIG. 6, the maximum thickness of load-resistant unit 110F is indicated by dimension 630.

In some cases, the surface of the protrusion facing the exposed side of the protective system can be offset from the exposed surface of the load-resistant unit. In the set of embodiments illustrated in FIG. 6, for example, the surfaces of protrusions 632 facing the exposed side of the protective system are offset from the exposed surface of the load-resistant unit by a distance 634. The offset can allow one to insert the protrusion into an adjacent indentation while maintaining a relatively smooth exposed surface along the outside of the protective system. In some cases, the length of the offset between the surface of the protrusion facing the exposed side of the protective system and the exposed surface of the load-resistant unit can be between about 0.01 and about 0.05 times the maximum cross-sectional dimension of the load-resistant unit.

Figure 4A:
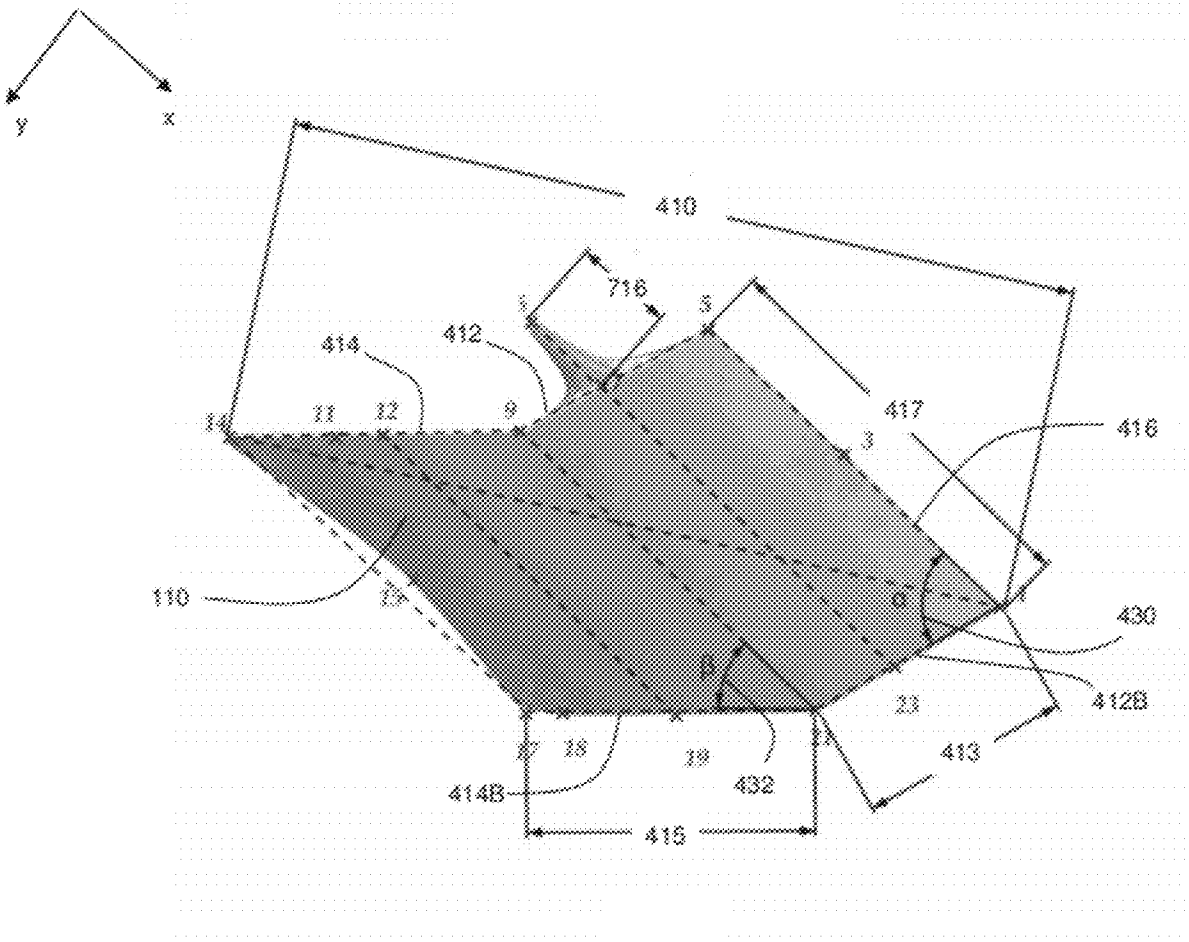
FIGS. 4A-4B include, according to one set of embodiments, schematic illustrations of a load-resistant unit.
Figure 4B:
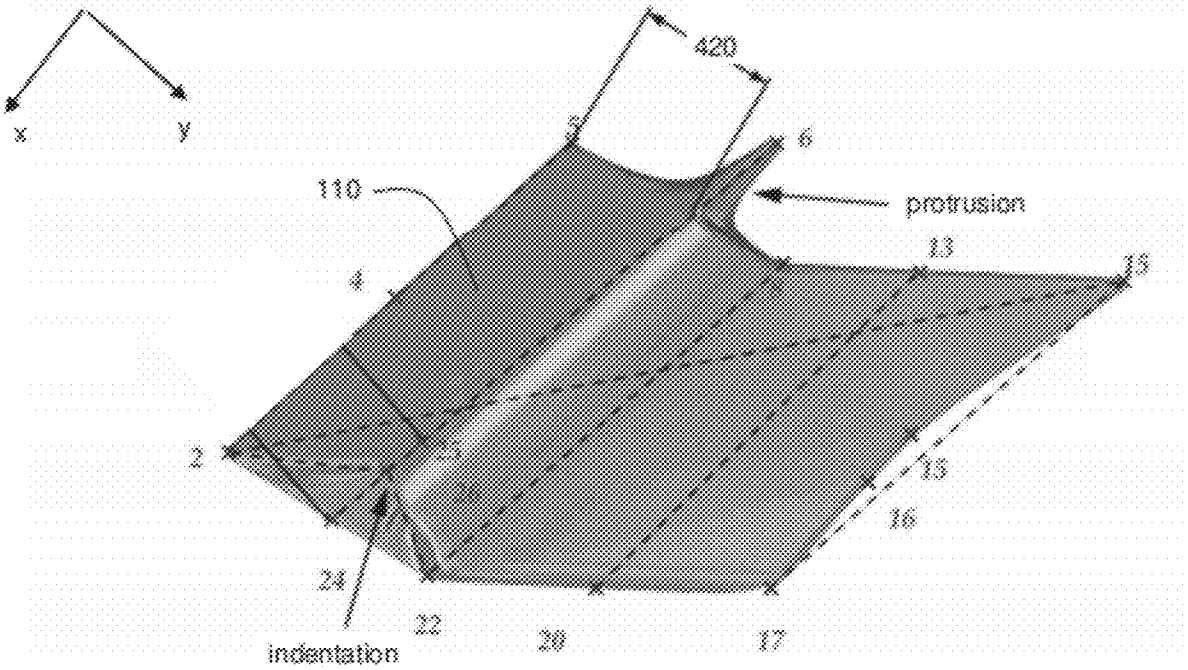

As mentioned above, the load-resistant units can be substantially V-shaped, in some cases. FIGS. 4A-4B include schematic illustrations of an exemplary V-shaped load-resistant unit, which can be used in any of the embodiments described herein. FIG. 4A includes a view of the load-resistant unit from exposed side 102, while FIG. 4B includes a view of the load-resistant unit from interior side 103.

A protrusion (e.g., which can form part of a peg-and-socket connection) can extend from one of the edges of the load-resistant unit that forms the concave angled edge of the V-shaped load-resistant unit (e.g., the edge extending from point 5 to point 14 in FIG. 4A). In some cases, the length of the edge of the V-shaped load-resistant unit from which its protrusion extends (e.g., edge 412 which extends from point 5 to point 9, the length of which is substantially similar to dimension 413 in FIG. 4A) can be between about 0.1 and about 0.6 times the maximum cross-sectional dimension of the load-resistant unit.

In some cases, the edge of the V-shaped unit that forms the concave angled surface from which no protrusion extends (e.g., edge 414 which extends from point 9 to point 14, the length of which corresponds to dimension 415 in FIG. 4A) can be between about 0.1 and about 0.7 times the maximum cross-sectional dimension of the load-resistant unit.

The lateral of the edges of the V-shaped unit (i.e., the edges substantially parallel to the x-axis in the figures) can be between about 0.3 and about 0.8 times the maximum cross-sectional dimension of the load-resistant unit. A lateral edge of the V-shaped unit is shown as edge 416 extending from point 1 to point 5 in FIG. 4A, the length of which is indicated by dimension 417. In some embodiments, the lateral edges of the V-shaped unit can be substantially parallel to the longitudinal axis of the protrusion of the unit constructed and arranged to form a peg-and-socket connection. In some cases, the lateral edges of the V-shaped units correspond to the edges that form the smallest angle relative to the longitudinal axis of the protrusion.

The edges of the V-shaped load-resistant units can form any suitable angle. In some cases, the body angle of the V-shaped load-resistant unit (the angle between edges 416 and 412B and shown as angle 430 in FIG. 4A) can be between about 30° and 100°. The body extension angle (the angle between edges 416 and 414B and shown as angle 432 in FIG. 4A) can be between about 10° and about 170°, between about 10° and about 90°, or between about 10° and about 45°.

In some embodiments, the longitudinal axis of the protrusion extending from the V-shaped load-resistant unit can be located along edge 412 such that it is offset from edge 416 a distance of between about 0.05 and about 0.3 times the maximum cross-sectional dimension of the load-resistant unit. This offset distance is indicated as dimension 420 in FIG. 4B. In some cases, the longitudinal axis of the protrusion extending from the V-shaped load-resistant unit can intersect the midpoint of edge 412.

The load-resistant systems described herein can include, in some embodiments, one or more optional layers of flexible material that can connect the load-resistant units. By connecting the load-resistant units to the layer(s) of material, the positions of the rows can be substantially maintained during flexing of the load-resistant system. In addition, the layer(s) of material can aid in resisting the force and dissipating energy associated with an applied mechanical load. Each of the layers can be made of any suitable material. For example, in some cases, the layers can include a polymer such as Kevlar®, polyethylene, polypropylene, polyester, polyamide, polyurethane, styrene-butadiene rubber, carbon fiber composites, carbon nanostructure composites (e.g., carbon nanotube composites), and ceramic composites, or combinations of these.

In the set of embodiments illustrated in FIG. 6, the protective system includes a first and second layers of flexible material 640 and 642, respectively. The average thickness of first layer 640 (indicated as dimension 641 in FIG. 6) can be between about 0.01 and about 0.5 times the average of the maximum cross-sectional dimensions of the load-resistant units in the protective system. The average thickness of second layer 642 (indicated as dimension 643 in FIG. 6) can be between about 0.05 and about 1 time the average of the maximum cross-sectional dimensions of the load-resistant units in the protective system.

In some embodiments, the load-resistant units are connected to a multi-layer base material via an intermediate material. For example, in the set of embodiments illustrated in FIG. 6, the load-resistant units are connected to an underlying multi-layer material (i.e., layers 640 and 642) via intermediate material 644. In some embodiments, the minimum distance between the load-resistant unit and the underlying multi-layer material (or the average of the minimum distances between a plurality of load-resistant units and an underlying multi-layer material) can be between about 0.01 and about 0.1 times the maximum cross-sectional dimension of the load-resistant unit (or the average of the maximum cross-sectional dimensions of the plurality of load-resistant units). The minimum distance between a load-resistant unit and an underlying multi-layer material is measured perpendicularly to the multi-layer material. For example, in the set of embodiments illustrated in FIG. 6, the minimum distance between load-resistant unit 110G and first layer 640 is indicated by dimension 646.

In some cases, the material underlying the load-resistant units might not completely cover the load-resistant units. For example, in the set of embodiments illustrated in FIG. 5, the material in layer 644 is detached from the lower surfaces of units 110A and 110B within cavity 550. In addition, in the set of embodiments illustrated in FIG. 6, material 644 is detached from the lower surfaces of units 110F and 110G within cavity 650 between adjacent rows to produce curve 652. In some cases, the radius of curvature of the cavities that are free of underlying material between adjacent rows within the protective system can be between about 0.3 and about 1 time the average of the largest cross-sectional dimensions of the load-resistant units within the protective system.

In some cases, the material underlying the load-resistant units can form an interfacial area with each of the load-resistant units (e.g., along surface 552 in FIG. 5). In some cases, the largest cross-sectional dimension of the interfacial area between the load-resistant unit and the underlying flexible material is between about 0.3 and about 0.8 times the largest cross-sectional dimension of the load-resistant unit.

While systems have been described in which units include a protrusion and/or an indentation, it should be understood that, in other systems, one or more units might include multiple protrusions and/or multiple indentations. For example, in one set of embodiments, unit 110D in FIG. 1A might include two protrusions, one fitting within an indentation of adjacent unit 110E, and another fitting within an indentation of adjacent unit 110C. In addition, unit 110C might include two indentations, one accommodating a protrusion from unit 110D, and another accommodating a protrusion from unit 110B.

Figure 9B:
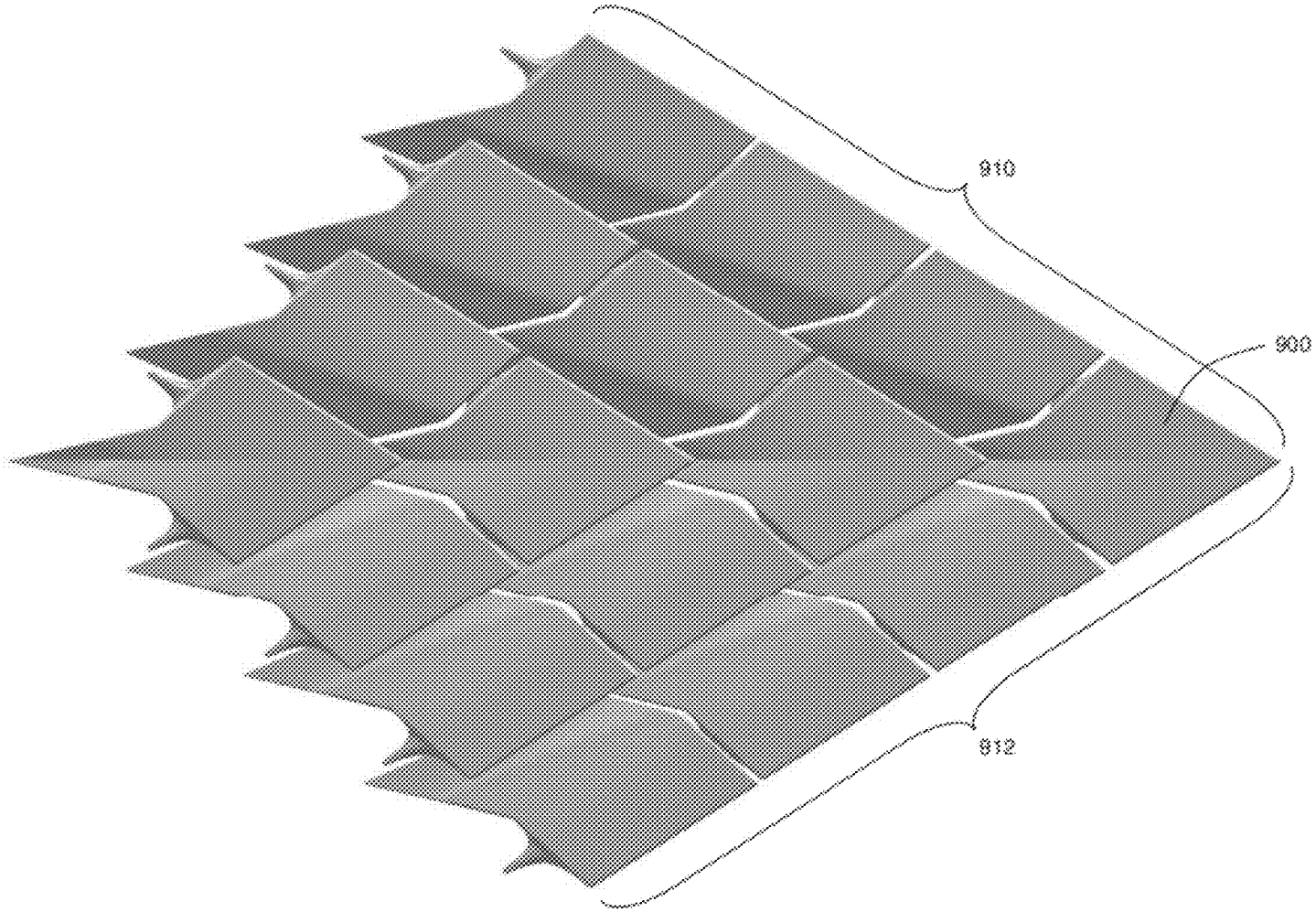
Figure 9C:
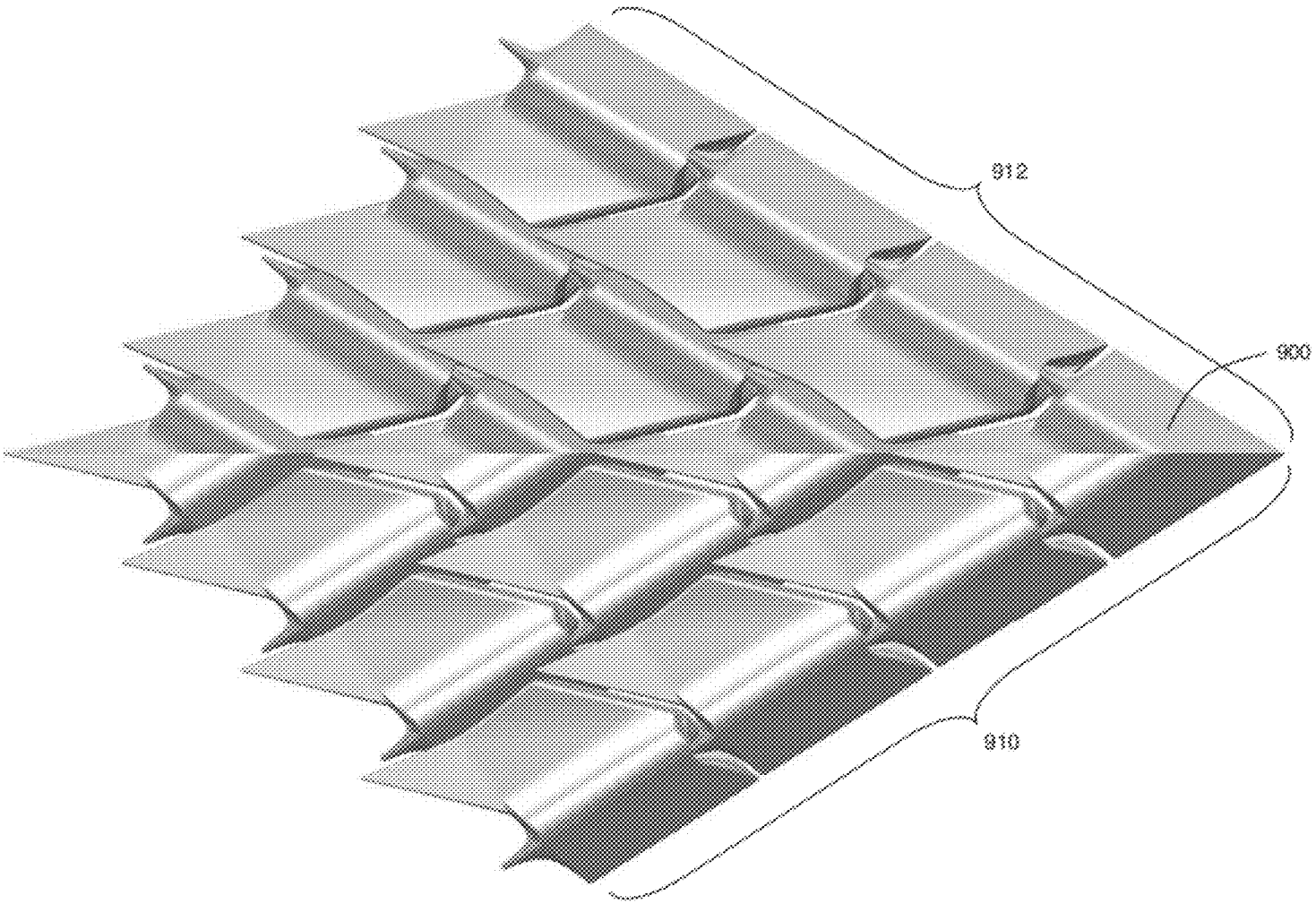

Units with multiple protrusions and/or multiple indentations can also be useful in joining rows of units arranged at an angle relative to each other. For example, unit 900 illustrated in FIG. 9A includes two protrusions 902 and 904 whose longitudinal axes (903 and 905, respectively) are arranged at an angle 906 relative to each other. By arranging the protrusions in this manner within a single unit, two rows of units can be arranged to intersect at a single unit, the angle between the rows defined by the angle of the protrusions within the single unit. FIG. 9B includes a top view of a system in which rows 910 and 912 are arranged to intersect at unit 900. FIG. 9C includes a bottom view of the system in FIG. 9B.

Figure 10A:
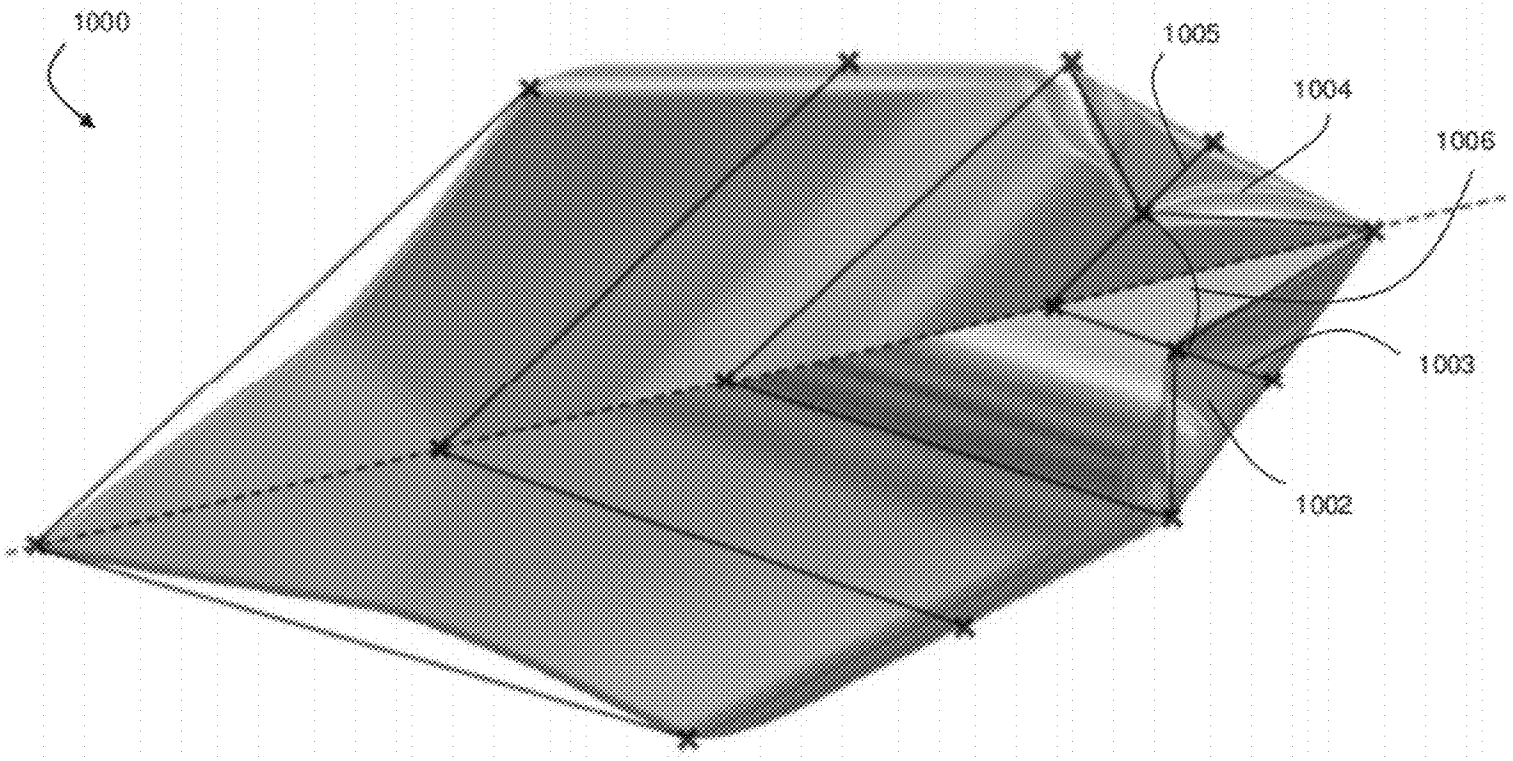
FIGS. 10A-10C include, according to some embodiments, schematic illustrations of (A) a load-resistant unit and (B-C) a system comprising the load resistant unit in FIG. 10A.
Figure 10B:
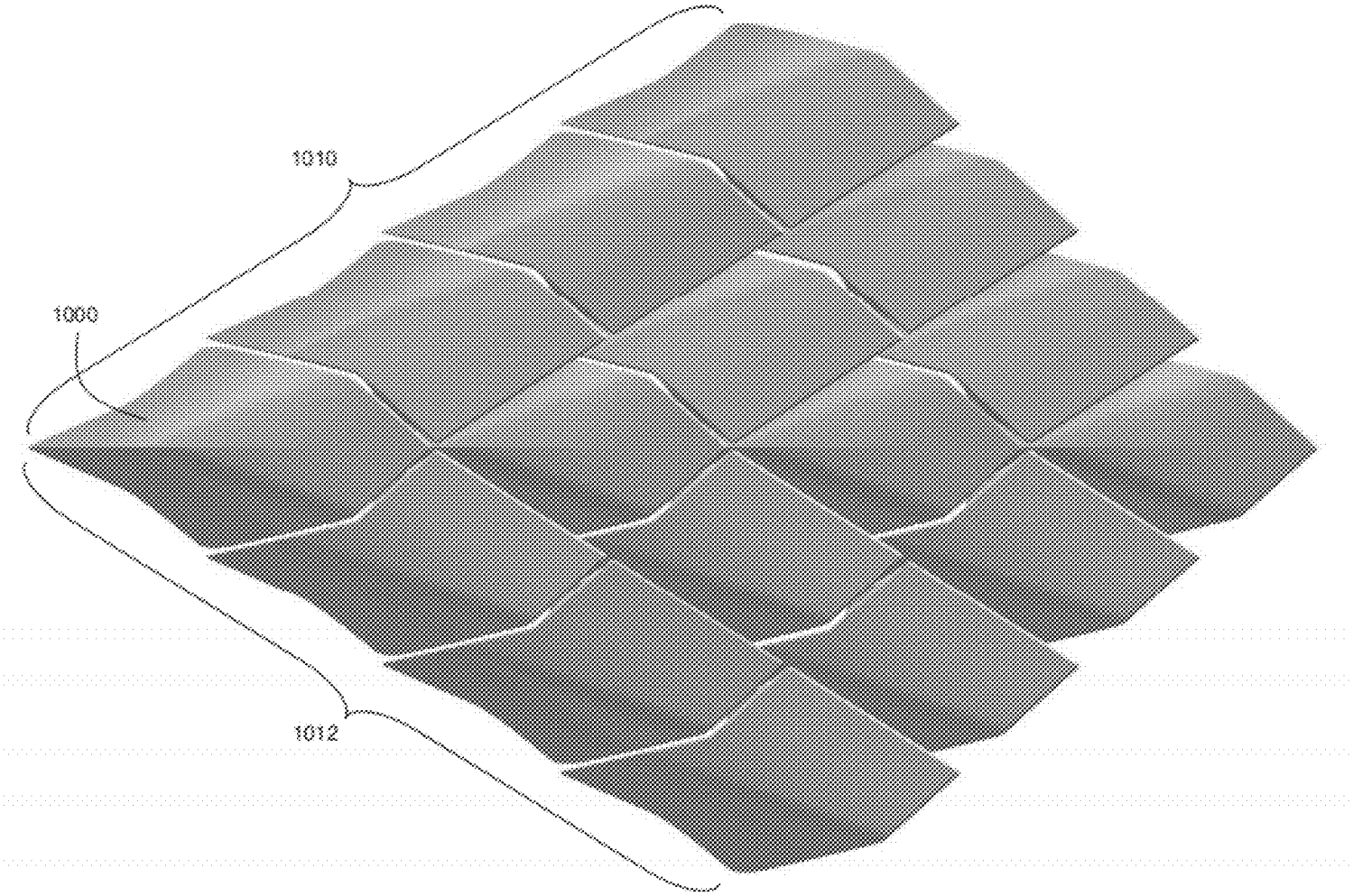
Figure 10C:
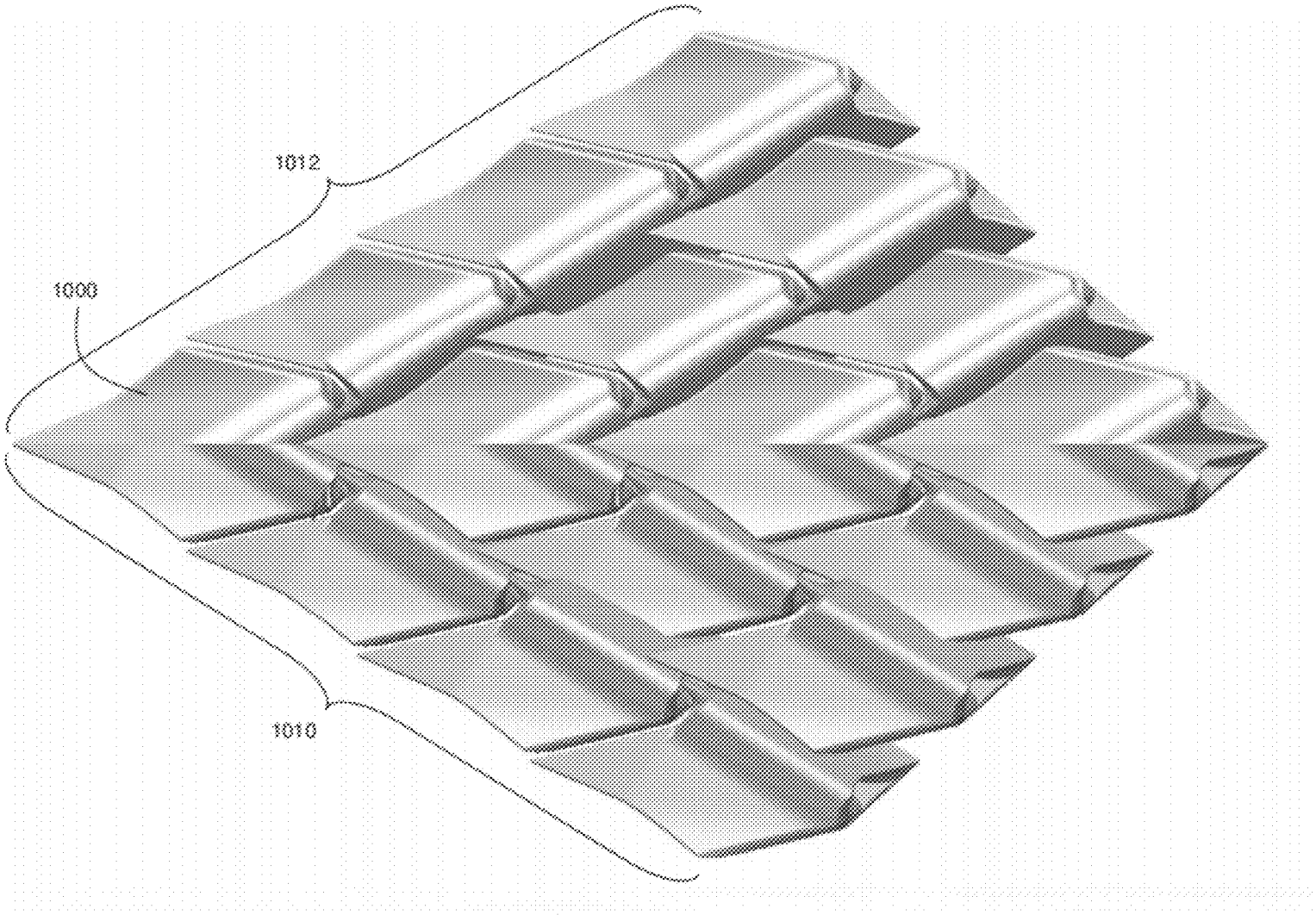

In some embodiments, a single unit can have two or more indentations, with longitudinal axes arranged at an angle relative to each other. For example, unit 1000 illustrated in FIG. 10A includes two indentations 1002 and 1004 whose longitudinal axes (1003 and 1005, respectively) are arranged at an angle 1006 relative to each other. FIG. 10B includes a top view of a system in which rows 1010 and 1012 are arranged to intersect at unit 1000. FIG. 10C includes a bottom view of the system illustrated in FIG. 10B.

The angle between the any two protrusions and/or indentations within a single unit (e.g., unit 900 or 1000) can be selected based upon the desired shape of the system. In some embodiments, the angle can be at least about 5°, at least about 15°, at least about 30°, at least about 45°, between about 5° and about 175°, or between about 5° and about 90°.

The articles described herein can be fabricated using any suitable method. In some embodiments, the articles can be fabricated using 3D printing. In some cases, the articles can be fabricated using injection molding (e.g., injection molding of polystyrene, a cyclo-olefin-copolymer, or another thermoplastic). Other methods that can be used to fabricate the articles and systems described herein include, but are not limited to, selective laser sintering (SLS), fused deposition modeling (FDM), and stereolithography (SL).

The protective systems described herein can be used in a wide variety of applications. In some embodiments, the load-resistant structures can be used as components of articles for the protection of a body (e.g., the human body). For example, in some cases, the load-resistant structures can be used in armor (e.g., bullet-proof vests or other types of body armor). The load-resistant structures might also be used, for example, as part of an athletic pad (e.g., for use in football, hockey, baseball, lacrosse, soccer, skiing, on- or off-road biking, skateboarding, or any other suitable sport in which pads are used). The systems described herein may also be useful in architectural applications, for example, in providing load resistance to exterior walls (e.g., via building skins), roofs, canopies, and/or other architectural components. In some cases, the load-resistant structures can be used to protect the exterior surfaces of vehicles (e.g., buses, trains, watercraft, etc.), conforming to the outer surface of the vehicle (e.g., multiple vehicle cars) during turns or other vehicle movements. The embodiments described herein may also be used in the protection of industrial equipment from blasts or other loads, protection of conduit (e.g., power lines) from mechanical load, or in packaging (e.g., product packaging, shipping packaging, etc.), for example, of goods (e.g., for sale or transport).

The protective systems of the invention can be essentially planar, for example, a side of a building, or non-planar, having a curved configuration, such as an automobile hood, fender, rooftop, bumper, rim, or the like or a curved piece of armor such as a tank turret, gun turret, bunker, helmet or vest, or the like or a curved aircraft component such as a fuselage component, engine housing, nose cone, wing section, or the like. Also included are ship or boat components such as hulls, propeller blades, and other components that can be subjected to damage from an applied load. Additional protective systems can include walls for race tracks designed to withstand indentation from a race car, guard rails or walls by roads, docks, other crash-resistant walls, clothing designed to withstand impact (for example, firemen's, policemen's, construction workers' protective clothing or the like).

The protective systems of the invention can be designed to resist a load having a component normal to a tangent of its surface. This means any tangent of the surface. That is, where the protective system has a non-planar surface, it can be designed to resist a load having a component normal to any tangent of the non-planar surface. The component normal to the tangent of the surface is that portion of, for example, a load having a vector force directed perpendicular to the tangent. That is, the protective system can be designed to resist a load directly perpendicular to the surface, and/or resist a load incident upon the surface from a non-perpendicular direction, such as a glancing blow or impact.

U.S. Provisional Patent Application Ser. No. 61/372,806, filed Aug. 11, 2010, and entitled "Articulating Protective System for Resisting Mechanical Loads" is incorporated herein by reference in its entirety for all purposes.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A non-naturally occurring protective article for resisting a mechanical load, comprising:

a plurality of load-resistant units arranged to form a plurality of rows, wherein:

at least one row contains a first unit comprising a peg which, when viewed from an exposed side of the protective article, extends from an edge of the first unit, the peg housed within a socket in an edge of a first adjacent unit within the row to form a peg and socket connection, wherein the peg is tapered from a base of the peg to a tip of the peg such that the base of the peg is thicker than the tip of the peg, and wherein the peg and socket connection allows for the first unit to move relative to the first adjacent unit, and the at least one row at least partially overlaps an adjacent row.

2. The protective article of claim 1, further comprising a material connecting at least a portion of a surface of the peg of the first unit with at least a portion of a surface of the socket in the first adjacent unit.

3. The protective article of claim 1, wherein surfaces of the units defining the exposed side of the article are curved.

4. The protective article of claim 1, wherein the protective article comprises an interior side, and surfaces of the units defining the interior side include first and second curved portions, wherein the first curved portion is concave and the second curved portion is convex.

5. The protective article of claim 1, wherein:

the protective article comprises a first axis substantially parallel to the rows of units and a second axis substantially perpendicular to the rows of units, and the protective article is more flexible along the second axis than along the first axis.

6. The protective article of claim 1, wherein the protective article comprises at least one of a piece of armor, a pad, a component of a building, and a package.

7. The protective article of claim 1, wherein at least one of the load-resistant units comprises a polymer, a metal, a ceramic, and/or carbon.

8. The protective article of claim 1, wherein the load-resistant units are substantially similar in size and/or shape.

9. The protective article of claim 1, wherein the load-resistant units are substantially different in size and/or shape.

10. The protective article of claim 9, wherein the size and/or shape of the load-resistant units are configured to impart a desired flexibility to at least a portion of the protective article.

11. The protective article of claim 9, wherein the size and/or shape of the load-resistant units are configured to accommodate a geometry of an article that is to be protected.

12. The protective article of claim 1, wherein the plurality of load-resistant units are configured to be exposed to an outside environment when the protective article is positioned proximate to an item to be protected.

13. The protective article of claim 1, wherein the protective article comprises a material adhering the peg of the first unit to the socket of the first adjacent unit.

14. The protective article of claim 1, comprising a sheet of material connecting at least a portion of the units within the at least one row and the adjacent row.

15. The protective article of claim 14, wherein the sheet comprises a multi-layered sheet.

16. The protective article of claim 14, wherein the protective article comprises an interior side, and surfaces of at least a portion of the units defining the interior side are connected by the sheet of material.

17. The protective article of claim 1, wherein the first unit, when viewed from the exposed side of the protective article, is V-shaped.

18. The protective article of claim 1, wherein the first unit, when viewed from the exposed side of the protective article, comprises a first angled edge and a second angled edge substantially parallel to the first angled edge.

19. The protective article of claim 1, wherein a thickness of the first unit in the region from which the peg extends is thicker than thicknesses of the remaining portions of the first unit.

20. The protective article of claim 1, wherein a length of the peg is between about 0.05 and about 0.3 times a maximum cross-sectional dimension of the first unit from which the peg extends.

21. The protective article of claim 1, wherein the first unit comprises a convex ridge having a longitudinal axis extending along the load-resistant unit in a direction substantially parallel to a longitudinal axis of the peg.

22. The protective article of claim 1, wherein the peg is tapered in a direction substantially perpendicular to a longitudinal axis of the peg.

23. The protective article of claim 1, wherein the tip of the peg is pointed.

24. The protective article of claim 1, wherein a thickness of the peg at the tip of the peg is between about 0.01 and about 0.07 times a maximum cross-sectional dimension of the first unit from which the peg extends.

25. The protective article of claim 1, wherein the first unit can be rotated around a longitudinal axis of the peg relative to the first adjacent unit.

26. The protective article of claim 1, wherein an angle between the first unit and the first adjacent unit can be changed by bending the first unit relative to the first adjacent unit.

27. The protective article of claim 1, wherein at least one surface of the peg is angled relative to an adjacent surface of the socket in which the peg is positioned.

28. The protective article of claim 1, wherein the peg comprises at least one curved surface.

29. The protective article of claim 28, wherein the curved surface has a radius of curvature that is between about 0.01 and about 0.1 times a maximum cross-sectional dimension of the first unit from which the peg extends.

30. The protective article of claim 28, wherein the peg further comprises a substantially planar surface facing the exposed side of the protective article.

31. The protective article of claim 1, wherein the at least one row and the adjacent row are constructed and arranged to slide relative to each other.

32. A non-naturally occurring protective article for resisting a mechanical load, comprising:

a plurality of load-resistant units arranged to form a plurality of rows, wherein:

at least one row contains a first unit comprising a peg which, when viewed from an exposed side of the protective article, extends from an edge of the first unit, the peg housed within a socket in an edge of a first adjacent unit within the row to form a peg and socket connection, the at least one row at least partially overlaps an adjacent row, the protective article comprises a first axis substantially parallel to the rows of units and a second axis substantially perpendicular to the rows of units, and the protective article is more flexible along the second axis than along the first axis.

33. The protective article of claim 32, wherein surfaces of the units defining the exposed side of the article are curved.

34. The protective article of claim 32, wherein the protective article comprises an interior side, and surfaces of the units defining the interior side include first and second curved portions, wherein the first curved portion is concave and the second curved portion is convex.

35. The protective article of claim 32, wherein the first unit, when viewed from the exposed side of the protective article, is V-shaped.

36. A non-naturally occurring protective article for resisting a mechanical load, comprising:

a plurality of load-resistant units arranged to form a plurality of rows, wherein:

at least one row contains a first unit comprising a peg which, when viewed from an exposed side of the protective article, extends from an edge of the first unit, the peg housed within a socket in an edge of a first adjacent unit within the row to form a peg and socket connection, the at least one row at least partially overlaps an adjacent row, the load-resistant units are substantially different in size and/or shape, and the size and/or shape of the load-resistant units are configured to impart a desired flexibility to at least a portion of the protective article.

37. The protective article of claim 36, wherein surfaces of the units defining the exposed side of the article are curved.

38. The protective article of claim 36, wherein the protective article comprises an interior side, and surfaces of the units defining the interior side include first and second curved portions, wherein the first curved portion is concave and the second curved portion is convex.

39. The protective article of claim 36, wherein:

the protective article comprises a first axis substantially parallel to the rows of units and a second axis substantially perpendicular to the rows of units, and the protective article is more flexible along the second axis than along the first axis.

40. The protective article of claim 36, wherein the first unit, when viewed from the exposed side of the protective article, is V-shaped.

41. A non-naturally occurring protective article for resisting a mechanical load, comprising:

a plurality of load-resistant units arranged to form a plurality of rows, wherein:

at least one row contains a first unit comprising a peg which, when viewed from an exposed side of the protective article, extends from an edge of the first unit, the peg housed within a socket in an edge of a first adjacent unit within the row to form a peg and socket connection, and the at least one row at least partially overlaps an adjacent row;

a sheet of material connecting at least a portion of the units within the at least one row and the adjacent row; and an interior side, wherein the surfaces of at least a portion of the units defining the interior side are connected by the sheet of material.

42. The protective article of claim 41, wherein surfaces of the units defining the exposed side of the article are curved.

43. The protective article of claim 41, wherein the protective article comprises an interior side, and surfaces of the units defining the interior side include first and second curved portions, wherein the first curved portion is concave and the second curved portion is convex.

44. The protective article of claim 41, wherein:

the protective article comprises a first axis substantially parallel to the rows of units and a second axis substantially perpendicular to the rows of units, and the protective article is more flexible along the second axis than along the first axis.

45. The protective article of claim 41, wherein the first unit, when viewed from the exposed side of the protective article, is V-shaped.

46. A non-naturally occurring protective article for resisting a mechanical load, comprising:

a plurality of load-resistant units arranged to form a plurality of rows, wherein:

at least one row contains a first unit comprising a peg which, when viewed from an exposed side of the protective article, extends from an edge of the first unit, the peg housed within a socket in an edge of a first adjacent unit within the row to form a peg and socket connection, the at least one row at least partially overlaps an adjacent row, and a thickness of the first unit in the region from which the peg extends is thicker than thicknesses of remaining portions of the first unit.

47. The protective article of claim 46, wherein surfaces of the units defining the exposed side of the article are curved.

48. The protective article of claim 46, wherein the protective article comprises an interior side, and surfaces of the units defining the interior side include first and second curved portions, wherein the first curved portion is concave and the second curved portion is convex.

49. The protective article of claim 46, wherein:

the protective article comprises a first axis substantially parallel to the rows of units and a second axis substantially perpendicular to the rows of units, and the protective article is more flexible along the second axis than along the first axis.

50. The protective article of claim 46, wherein the first unit, when viewed from the exposed side of the protective article, is V-shaped.

51. A non-naturally occurring protective article for resisting a mechanical load, comprising:

a plurality of load-resistant units arranged to form a plurality of rows, wherein:

at least one row contains a first unit comprising a peg which, when viewed from an exposed side of the protective article, extends from an edge of the first unit, the peg housed within a socket in an edge of a first adjacent unit within the row to form a peg and socket connection, the at least one row at least partially overlaps an adjacent row, and the first unit comprises a convex ridge having a longitudinal axis extending along the load-resistant unit in a direction substantially parallel to a longitudinal axis of the peg.

52. The protective article of claim 51, wherein surfaces of the units defining the exposed side of the article are curved.

53. The protective article of claim 51, wherein the protective article comprises an interior side, and surfaces of the units defining the interior side include first and second curved portions, wherein the first curved portion is concave and the second curved portion is convex.

54. The protective article of claim 51, wherein:

the protective article comprises a first axis substantially parallel to the rows of units and a second axis substantially perpendicular to the rows of units, and the protective article is more flexible along the second axis than along the first axis.

55. The protective article of claim 51, wherein the first unit, when viewed from the exposed side of the protective article, is V-shaped.

* * * * *